US010584442B2

(12) United States Patent
Lund et al.

(10) Patent No.: US 10,584,442 B2
(45) Date of Patent: Mar. 10, 2020

(54) ENZYMATIC PROCESS COMBINED WITH HOT CAUSTIC EXTRACTION FOR THE REMOVAL OF HEMICELLULOSES FROM PAPER-GRADE PULP

(71) Applicant: NOVOZYMES A/S, Bagsvaerd (DK)

(72) Inventors: Henrik Lund, Bagsvaerd (DK); Pedro Emanuel Garcia Loureiro, Soeborg (DK); Jaroslav Slavik, New Brunswick (CA)

(73) Assignee: NOVOZYMES A/S, Bagsvaerd (DK)

( * ) Notice: Subject to any disclaimer, the term of this patent is extended or adjusted under 35 U.S.C. 154(b) by 134 days.

(21) Appl. No.: 15/525,326

(22) PCT Filed: Nov. 16, 2015

(86) PCT No.: PCT/EP2015/076668
§ 371 (c)(1),
(2) Date: May 9, 2017

(87) PCT Pub. No.: WO2016/079045
PCT Pub. Date: May 26, 2016

(65) Prior Publication Data

US 2017/0350072 A1 Dec. 7, 2017

(30) Foreign Application Priority Data

May 1, 2015 (EP) ..... 15166103

(51) Int. Cl.

| | |
|---|---|
| ***D21C 5/00*** | (2006.01) |
| ***D21C 9/10*** | (2006.01) |
| ***D21C 9/14*** | (2006.01) |
| ***D21C 9/16*** | (2006.01) |
| ***D21C 9/00*** | (2006.01) |
| ***D21C 3/02*** | (2006.01) |
| ***D21C 9/153*** | (2006.01) |
| *D21C 9/147* | (2006.01) |

(52) U.S. Cl.
CPC ..... *D21C 5/005* (2013.01); *D21C 3/02* (2013.01); *D21C 5/00* (2013.01); *D21C 9/00* (2013.01); *D21C 9/14* (2013.01); *D21C 9/153* (2013.01); *D21C 9/16* (2013.01)

(58) Field of Classification Search
None
See application file for complete search history.

(56) References Cited

U.S. PATENT DOCUMENTS

| | | | | |
|---|---|---|---|---|
| 6,057,438 | A * | 5/2000 | Hyatt | C08B 37/0057 162/55 |
| 6,254,722 | B1 | 7/2001 | Jackson | |
| 6,512,110 | B1 * | 1/2003 | Heikkila | C12P 19/14 127/30 |
| 7,320,741 | B2 * | 1/2008 | Tolan | D21C 9/1057 162/73 |
| 7,541,175 | B1 * | 6/2009 | Tolan | D21C 9/1057 162/73 |
| 8,652,301 | B2 * | 2/2014 | Bryant | D21C 5/005 162/181.1 |
| 2008/0295986 | A1 * | 12/2008 | Pekkala | D21C 9/002 162/175 |
| 2012/0159840 | A1 * | 6/2012 | Koskinen | C12N 9/2434 44/307 |

FOREIGN PATENT DOCUMENTS

| | | | |
|---|---|---|---|
| WO | 85/004201 | A1 | 9/1985 |
| WO | 95/000698 | A1 | 1/1995 |
| WO | 98/016682 | A1 | 4/1998 |
| WO | 98/056958 | A1 | 12/1998 |
| WO | 02/052100 | A2 | 7/2002 |
| WO | 02/057541 | A2 | 7/2002 |
| WO | 2007/065969 | A1 | 6/2007 |

OTHER PUBLICATIONS

"Taxonomy—Caldicellulosiruptor saccharolyticus (Caldocellum saccharolyticum)", UniProt, 2 pages, [online], 2018, retrieved from the Internet, [retrieved Jan. 13, 2019, <URL: https://www.uniprot.org/taxonomy/44001>. (Year: 2018).*
Christov et al, 1994, Appl Microbiol Biotechnol 42, 492-498.

* cited by examiner

*Primary Examiner* — Dennis R Cordray
(74) *Attorney, Agent, or Firm* — Adam Rucker

(57) ABSTRACT

The present invention relates to the removal of hemicelluloses from paper-grade alkaline pulp thereby upgrading the pulp e.g. into dissolving-grade pulp using a combination of enzyme treatment, hot caustic extraction and optionally one or more bleaching steps.

20 Claims, No Drawings

Specification includes a Sequence Listing.

ENZYMATIC PROCESS COMBINED WITH HOT CAUSTIC EXTRACTION FOR THE REMOVAL OF HEMICELLULOSES FROM PAPER-GRADE PULP

CROSS-REFERENCE TO RELATED APPLICATIONS

This application is a 35 U.S.C. 371 national-stage application of PCT/EP2015/076668, filed Nov. 16, 2015, and claims priority under 35 U.S.C. 119 to European Patent Application No. 14193410.9, filed Nov. 17, 2014, and European Patent Application No. 15166103.0, filed May 1, 2015, the contents of which are fully incorporated herein by reference.

REFERENCE TO SEQUENCE LISTING

This application contains a Sequence Listing in computer readable form. The computer readable form is incorporated herein by reference.

FIELD OF THE INVENTION

The present invention relates to the removal of hemicelluloses (partly or completely) from paper-grade alkaline pulp (such as kraft pulp or soda pulp) thereby upgrading the pulp e.g. into dissolving-grade pulp using a combination of enzyme treatment, hot caustic extraction and optionally one or more bleaching steps.

BACKGROUND OF THE INVENTION

Pulp is a lignocellulosic fibrous material prepared by chemically or mechanically separating cellulose fibres from wood, fibre crops or waste paper.

A pulp mill converts wood chips or other plant fibre source into a thick fibre board (market pulp) which can be shipped and traded as paper-grade or dissolving-grade pulp. Pulp can be manufactured using mechanical, semi-chemical or fully chemical methods (e.g. kraft and sulfite processes). The finished product may be either bleached or non-bleached, depending on the customer requirements.

Wood and other plant materials used to make pulp contain three main components (apart from water): cellulose, lignin and hemicelluloses. The aim of pulping is to break down the bulk structure of the fibre source, be it chips, stems or other plant parts, into the constituent fibres. Chemical pulping achieves this by degrading most part of the lignin and to a different extent hemicelluloses into small, water-soluble molecules which can be washed away from the cellulose fibres while controlling the extent of cellulose degradation. The various mechanical pulping methods, such as groundwood (GW) and refiner mechanical pulping (RMP), physically tear the cellulose fibres from each other. Much of the lignin remains adhering to the fibres. There are a number of related hybrid pulping methods that use a combination of chemical and thermal treatment to begin an abbreviated chemical pulping process, followed immediately by a mechanical treatment to separate the fibres. These hybrid methods include thermomechanical pulping, also known as TMP, and chemithermomechanical pulping, also known as CTMP. The chemical and thermal treatments reduce the amount of energy subsequently required by the mechanical treatment, and also reduce the amount of strength loss suffered by the fibres.

Dissolving pulp or dissolving-grade pulp is a chemical bleached pulp with a high cellulose content enough to be suitable for the production or regenerated cellulose and cellulose derivatives. Dissolving pulp has special properties, such as a high level of brightness and uniform molecular-weight distribution. Dissolving pulp is manufactured for uses that require a high chemical cellulose purity, and particularly low hemicellulose content, since the chemically similar hemicellulose can interfere with subsequent processes. Dissolving pulp is so named because it is not made into paper, but dissolved either in a solvent or by derivatization into a homogeneous solution, which makes it completely chemically accessible and removes any remaining fibrous structure. Once dissolved, it can be spun into textile fibers (such as viscose or Lyocell), or chemically reacted to produce derivatized celluloses, such as cellulose triacetate, a plastic-like material formed into fibers or films, or cellulose ethers such as methyl cellulose, used as a thickener.

An object of the present invention is to upgrade paper-grade pulp (unbleached or partially bleached or fully bleached or bleached market pulp) by removal of hemicelluloses e.g. into dissolving-grade pulp using a combination of enzyme treatment, hot caustic extraction (HCE) and optionally one or more bleaching steps.

HCE has previously only been used as a purification process for sulphite-based production of dissolving pulps and has been considered to not contribute much to the purity of pulps produced from alkaline cooking processes, such as soda and kraft. The other existing alkaline purification process is cold caustic extraction (CCE) which is operated close to room temperature (<40° C.) and at very high sodium hydroxide concentration (1.2-3.0 M equivalent to 5-12% w/w in the liquid phase), while the hot purification process (HCE) is usually run at 70-130° C. and at low NaOH concentration (0.1-0.4 M equivalent to 0.4-1.4% w/w in the liquid phase and typically <0.25 M equivalent to <1.0% w/w in the liquid phase).

The present invention enables the use of HCE as a purification process in the fiberline of an alkaline based pulping process for removal of hemicelluloses e.g. for the production of dissolving pulp through the combined use of a prior enzymatic-stage with hemicellulases.

WO9816682 A2 discloses a process for upgrading paper-grade wood pulp to dissolving-grade pulp by using caustic extraction and xylanase treatments in combination in different steps. However, the concentration range of NaOH disclosed in WO9816682 A2 is very high ranging from 8-12% w/w which is within the same NaOH dosage range as carried out in cold caustic extraction (CCE) but using a non-conventional high temperature of 50-100° C.

The combination of enzyme-treatment with hemicellulases and hot caustic extraction (0.03 g NaOH/g pulp, 80° C., 1 h, 2.5% pulp consistency) was studied by Christov and Prior 1994 (*Appl Microbiol Biotechnol* 42:492-498) but for acid sulphite pulps and using lower NaOH concentration (0.02M) at low consistency.

In the present invention, the use of an enzyme-stage with hemicellulases can activate the alkaline pulp, such as kraft pulp, for the alkaline purification process in the HCE-stage. The hemicellulases will generate a significant amount of new reducing end groups in the hemicelluloses which in turn can trigger alkaline endwise peeling reactions under the high temperature and alkalinity conditions that can be found in the following HCE-stages.

SUMMARY OF THE INVENTION

Wood pulp requires extensive purification before it is suitable for making man-made textile cellulosic fibers (regenerated cellulose) such as viscose, and for making cellulose derivatives, such as esters or ethers. This type of pulp referred as dissolving grade-pulp can be produced by i) acid sulfite pulping followed by bleaching and possibly additional purification processes or ii) by pre-hydrolysis-kraft pulping followed by bleaching and possibly additional purification processes.

The additional purification, which involves treatment with alkali to remove and destroy hemicelluloses and bleaching to remove and destroy lignin reduces the yield and increases the cost of a "dissolving-grade" cellulose derived from wood pulp. The invention provides a method for upgrading paper-grade alkaline pulp e.g. into dissolving-grade pulp using a combination of enzyme treatment and hot caustic extraction.

The invention relates to a method (termed "Method I") for removal of hemicelluloses (partly or completely) from paper-grade alkaline pulp comprising the steps of i) treating the paper-grade alkaline pulp with one or more hemicellulases;

ii) performing hot caustic extraction of the paper-grade alkaline pulp with an alkaline source at a temperature from 70° C. to 160° C. and at alkaline conditions of from 0.01 M to 1 M hydroxide ions;

iii) optionally bleaching the pulp obtained in step i) and/or ii) in one or more bleaching steps if ISO brightness of the pulp is below 90% (e.g. with one or more D stage)

and thereby removing at least 20% of the hemicelluloses from the paper-grade alkaline pulp.

The invention further relates to a method (termed "Method II) for removal of hemicelluloses from paper-grade alkaline pulp comprising the steps of i) treating the paper-grade alkaline pulp with one or more hemicellulases (X stage);

ii) performing hot caustic extraction of the paper-grade alkaline pulp using an alkaline source at a temperature from 70° C. to 160° C. and alkaline conditions of from 0.01 M to 1 M hydroxide ions (HCE stage);

iii) optionally bleaching of the pulp obtained in step i) and/or ii) in one or more bleaching steps if ISO brightness of the pulp is below 90% (e.g. with one or more D stage);

iv) optionally repeating step i) and/or ii) (one or more times) if the pulp obtained in step i) and/or ii) contains more than 10% hemicelluloses;

and thereby generating dissolving pulp containing less than 10% hemicelluloses.

Hemicelluloses used in Method I or II can comprise xylan and/or mannan.

Method I can in one embodiment be used for production of dissolving-grade pulp.

Preferably one or more hemicellulases used in step i) in Method I or II comprise or consist of one or more xylanases. In another preferred embodiment the one or more hemicellulases used in step i) in Method I or II comprise or consist of one or more mannanases. In a specific embodiment a mannanase is required when the paper-grade alkaline pulp contains mannan.

In a specific embodiment the one or more xylanases used in step i) in Method I or II can be selected from the group consisting of SEQ ID NO: 4 and SEQ ID NO: 5. The one or more xylanases used in step i) in Method I or II can have a sequence identity of at least 60% [such as at least 65%, such as at least 70%, such as at least 75%, such as at least 80%, such as at least 85%, such as at least 90%, such as at least 95%, such as at least 99%] with one or more xylanases selected from the group consisting of SEQ ID NO: 4 and SEQ ID NO: 5.

In another specific embodiment the one or more mannanases used in step i) in Method I or II can be selected from the group consisting of SEQ ID NO: 1, SEQ ID NO: 2, SEQ ID NO: 3, SEQ ID NO: 6 and SEQ ID NO: 7. The one or more mannanases used in step i) in Method I or II can have a sequence identity of at least 60% [such as at least 65%, such as at least 70%, such as at least 75%, such as at least 80%, such as at least 85%, such as at least 90%, such as at least 95%, such as at least 99%] with one or more mannanases selected from the group consisting of SEQ ID NO: 1, SEQ ID NO: 2, SEQ ID NO: 3, SEQ ID NO: 6 and SEQ ID NO: 7.

The one or more hemicellulases used in step i) in Method I or II can also comprise one or more xylanases and one or more mannanases.

The concentration of the one or more hemicellulases used in step i) in Method I or II is preferably from 0.05 mg/kg oven dry pulp to 100 mg/kg oven dry pulp. The alkali source used in step ii) in Method I or II can in a preferred embodiment consist of or comprise NaOH. The alkali source used in step ii) in Method I or II can also consist of or comprise one or more alkali sources selected from the group consisting of NaOH, $Ca(OH)_2$, $NH_4OH$ and $Mg(OH)_2$. The hot caustic extraction in step ii) in Method I or II can be performed with a NaOH concentration of less than 1 M, such as less than 0.5 M or such as less than 0.1 M. In one embodiment hot caustic extraction in step ii) in Method I or II is performed at a temperature between 80° C. and 130° C. such as between 90° C. and 110° C.

The paper-grade alkaline kraft pulp can be selected from the group consisting of alkaline hardwood pulp, alkaline softwood pulp, kraft pulp, hardwood kraft pulp, softwood kraft pulp, soda pulp, hardwood soda pulp and softwood soda pulp, or any mixture thereof.

The hemicellulose content of the pulp obtained by Method I or II such as a dissolving-grade pulp can in one embodiment be less than 10%, such as less than 5%, such as less than 4%, such as less than 3%, such as less than 2% or such as less than 1%.

In a preferred embodiment step i) in Method I or II is performed prior to step ii).

In a specific embodiment of Method I or II the paper-grade alkaline pulp is softwood pulp or a mixture of softwood and hardwood pulp and the one or more hemicellulases comprises or consists of one or more xylanases and one or more mannanases.

In a specific embodiment of Method I or II the paper-grade alkaline pulp contains or comprises mannan and the one or more hemicellulases comprises or consists of one or more xylanases and one or more mannanases.

In a preferred embodiment of Method II the method comprises a sequence of stages selected from the group consisting of X-HCE, X-D-HCE, X-D-HCE-X-HCE-D, X-D-HCE-X-D-HCE-D, X-Z-HCE, X-D-HCE-X-HCE-Z, X-Z-HCE-X-HCE-D, X-Paa-HCE, X-D-HCE-X-HCE-Paa and X-Paa-HCE-X-HCE-D (wherein in X is the enzyme stage—i.e. treatment with one or more hemicellulases; HCE is the hot caustric extraction stage as defined elsewhere herein and D is a bleaching stage with chlorine dioxide). The D stage described above in Method II can instead of a chlorine dioxide bleaching be treatment with other oxidizing agents such as chlorine, oxygen, hydrogen peroxide, ozone or peracetic acid, a reducing agent or any combination of these bleaching methods.

The invention further relates to a pulp such as a dissolving-grade pulp made by the method according to the invention (Method I or II) and to textile fibers (regenerated cellulose) made of said dissolving pulp.

Use of said dissolving-grade pulp for textile production and use of the dissolving-grade pulp according to the invention for production of textile fibers is also within the scope of the invention. Finally, the invention relates to use of the dissolving-grade pulp according to the invention for production of derivatized celluloses (cellulose derivatives).

OVERVIEW OF SEQUENCE LISTING

SEQ ID NO: 1 is the amino acid sequence of the mature mannanase isolated from *Ascobolus stictoideus*.

SEQ ID NO: 2 is the amino acid sequence of the mature mannanase isolated from *Chaetomium virescens*.

SEQ ID NO: 3 the amino acid sequence of a GH5 mannanase from *Trichoderma reesei* (SWISSPROT:Q99036).

SEQ ID NO: 4 is the amino acid sequence of xylanase isolated from *Bacillus agaradhaerens*.

SEQ ID NO: 5 is the amino acid sequence of a truncated version of a xylanase from *Dictyoglomus thermophilum*.

SEQ ID NO: 6 is amino acid sequence of a GH5 mannanase from *Caldicellulosiruptor saccharolyticus*.

SEQ ID NO: 7 is amino acid sequence of a GH5 mannanase from *Talaromyces leycettanus*.

DEFINITIONS

Alkaline pulp: In an alkaline pulping processes the lignin which is present in the raw material of wood and bonds the fibers of cellulose together is removed under strongly alkaline circumstances in order to generate alkaline pulp. The alkaline pulping process includes sulphate pulping also known as kraft pulping and soda pulping. Other examples of alkaline pulping include soda-amine [particularly soda-ethylenediamine (EDA)] pulping, soda-anthraquinone (AQ) pulping, kraft-AQ pulping, and soda-AQ/EDA. Sodium borohydride, hydrogen sulphide, polysulphide and anthraquinone are examples of agents that have been used to provide higher yield in alkaline pulping processes.

"Bleaching" is the removal of color from pulp, primarily the removal of traces of lignin which remains bound to the fiber after the primary pulping operation. Bleaching usually involves treatment with oxidizing agents such as chlorine (C-stage), chlorine dioxide (D-stage), oxygen (O-stage), hydrogen peroxide (P-stage), ozone (Z-stage) and peracetic acid (Paa-stage) or a reducing agent such as sodium dithionite (Y-stage). There are chlorine ($Cl_2$; C-stage) free processes such as the elemental chlorine free (ECF) bleaching where chlorine dioxide ($ClO_2$; D-stage) is mainly used and typically followed by an alkaline extraction stage. Totally chlorine free (TCF) bleaching is another process where mainly oxygen-based chemicals are used.

Dissolving pulp: the term "dissolving pulp" is synonymous with "dissolving cellulose" and "dissolving-grade pulp" and refers to bleached pulp (such as bleached wood pulp, bleached annual plant pulp and other bleached plant pulp) that has a high cellulose content. The cellulose content of the dissolving pulp is preferably at least 90% (weight/weight) such as at least 91%, at least 92%, at least 93%, at least 94%, at least 95%, at least 96%, at least 97%, at least 98% or at least 99% (w/w). Dissolving pulp is manufactured for uses that require a high chemical purity, and particularly low hemicellulose content. The hemicellulose content of the dissolving pulp is less than 10% (weight/weight) such as less than 9%, less than 8%, less than 7%, less than 6%, less than 5%, less than 4%, less than 3%, less than 2% or less than 1% (w/w). Dissolving pulp can e.g. be used for generation of regenerated cellulose or for generation of cellulose derivatives. "Dissolving-grade pulp" is pulp that has been purified sufficiently for use in the production of viscose rayon, cellulose ethers, or cellulose esters with organic or inorganic acids. It may be produced from alkaline pulp such as either kraft pulp or soda pulp by the method according to the present invention. Historically, dissolving-grade pulp (in contrast to paper-grade pulp) referred to pulp which reacted with carbon disulfide to afford a solution of cellulose xanthate which then could be spun into fibers (viscose rayon) with evolution of carbon disulfide and regeneration of cellulose. Dissolving-grade pulp now refers as well to pulp which is used to manufacture various cellulose derivatives such as inorganic and organic esters, ethers, besides other textile rayon fibers such as lyocell, modal and the like.

Hemicellulases: "Hemicellulolytic enzyme" or "hemicellulase" means one or more (e.g., several) enzymes that hydrolyze a hemicellulosic material.

Hot Caustic Extraction (HCE): the term "Hot Caustic Extraction" (HCE) is synonymous with "hot alkali extraction". HCE is a method to remove short chain hemicellulose and amorphous cellulose in pulps. Compared to (CCE)-stage (cold caustic extraction) a hot caustic extraction (HCE)-stage is carried out at higher temperatures, often together with higher pulp consistency and lower NaOH concentration.

ISO Brightness: ISO Brightness is defined in ISO 2470-1 (method for measuring ISO brightness of pulps, papers and boards), it is the intrinsic radiance [reflectance] factor measured with a reflectometer having the characteristics described in ISO 2469.

Kraft pulp: "Kraft pulp" is synonymous with "sulphate pulp". Kraft pulp is produced by digesting wood chips at temperatures above about 120° C. with a solution of sodium hydroxide and sodium sulfide. Some kraft pulping is also done in which the sodium sulfide is augmented by oxygen or anthraquinone. Although kraft pulping removes most of the lignin originally present in the wood, enough remains that one or more bleaching steps may be required to give pulp of acceptable brightness according to the intended application. As compared with soda pulping, kraft pulping is particularly useful for pulping of softwoods, which contain a higher percentage of lignin than hardwoods.

Paper-grade alkaline pulp: a pulp produced by a conventional alkaline cooking process with the main purpose of removing lignin while preserving hemicelluloses and cellulose in the cooking stage. Paper-grade alkaline pulp comprises unbleached or partially bleached or fully bleached or bleached market pulp). Unbleached means pulp that has not been bleached. Partially bleached means pulp that was bleached by one or more bleaching stages but less bleached than market pulp; typically with less than 80% ISO brightness. Fully bleached means pulp bleached until a commercial ISO brightness level before drying, typically having ISO brightness above 80%. Bleached market pulp is commercial bleached pulp sold as a dried finished product.

Pulp: "pulp" or "paper pulp" or "paper-grade pulp" is a lignocellulosic fibrous material prepared by chemically or mechanically separating cellulose fibres from wood, fibre crops or waste paper. "Pulp" is also an aggregation of random cellulosic fibers obtained from plant fibers. As used herein, the term "pulp" refers to the cellulosic raw material used in the production of paper, paperboard, fiberboard, and similar manufactured products. Pulp is obtained principally from wood which has been broken down by mechanical and/or chemical action into individual fibers. Pulp may be made from e.g. hardwoods (angiosperms) or softwoods (conifers or gymnosperms). Hardwood and softwood pulps differ in both the amount and the chemical composition of the hemicelluloses which they contain. In hardwoods, the principal hemicellulose (25-35%) is glucuronoxylan while softwoods contain chiefly glucomannan (25-30%) (Douglas W. Reeve, Pulp and Paper Manufacture, Vol. 5, pp. 393-396).

Soda pulp: Soda pulp is produced by digesting wood chips at elevated temperatures with aqueous sodium hydroxide.

DETAILED DESCRIPTION OF THE INVENTION

The invention relates to a method for upgrading paper-grade pulp by removal of hemicelluloses e.g. into dissolving-grade pulp using a combination of enzyme treatment, hot caustic extraction and optionally one or more bleaching steps.

The invention relates to a method (termed "Method I") for removal of hemicelluloses (partly or completely) from paper-grade alkaline pulp comprising the steps of i) treating the paper-grade alkaline pulp with one or more hemicellulases;

ii) performing hot caustic extraction of the paper-grade alkaline pulp with an alkaline source at a temperature from 70° C. to 160° C. and at alkaline conditions of from 0.01 M to 1 M hydroxide ions (such as from 0.02 M to 1 M hydroxide ions);

iii) optionally bleaching the pulp obtained in step i) and/or ii) in one or more bleaching steps if ISO brightness of the pulp is below 90% (e.g. with one or more D stage);

and thereby removing at least 20% of the hemicelluloses from the paper-grade alkaline pulp.

The invention further relates to a method (termed "Method II) for removal of hemicelluloses from paper-grade alkaline pulp comprising the steps of i) treating the paper-grade alkaline pulp with one or more hemicellulases (X stage);

ii) performing hot caustic extraction of the paper-grade alkaline pulp using an alkaline source at a temperature from 70° C. to 160° C. and alkaline conditions of from 0.01 M to 1 M hydroxide ions (HCE stage);

iii) optionally bleaching of the pulp obtained in step i) and/or ii) in one or more bleaching steps if ISO brightness of the pulp is below 90% (e.g. with one or more D stage);

iv) optionally repeating step i) and/or ii) (one or more times) if the pulp obtained in step i) and/or ii) contains more than 10% hemicelluloses;

and thereby generating dissolving pulp containing less than 10% hemicelluloses.

Method I can in one embodiment be used for production of dissolving-grade pulp.

Details concerning specific embodiments regarding step i) and step ii) in "Method I" or "Method II" are given herein below.

In a preferred embodiment step i) is performed prior to step ii) in "Method I" or "Method II".

Use of Hemicellulolytic Enzyme or Hemicellulases in Step i) in "Method I" or "Method II":

The one or more hemicellulolytic enzyme or hemicellulases used in step i) in "Method I" or "Method II" is further exemplified herein below.

"Hemicellulolytic enzyme" or "hemicellulase" means one or more (e.g., several) enzymes that hydrolyze a hemicellulosic material. See, for example, Shallom and Shoham, *Current Opinion In Microbiology,* 2003, 6(3): 219-228). Hemicellulases are key components in the degradation of plant biomass. Examples of hemicellulases include, but are not limited to, an acetylmannan esterase, an acetylxylan esterase, an arabinanase, an arabinofuranosidase, a coumaric acid esterase, a feruloyl esterase, a galactosidase, a glucuronidase, a glucuronoyl esterase, a mannanase, a mannosidase, a xylanase, and a xylosidase. The substrates for these enzymes, hemicelluloses, are a heterogeneous group of branched and linear polysaccharides that are bound via hydrogen bonds to the cellulose microfibrils in the plant cell wall, crosslinking them into a robust network. Hemicelluloses are also covalently attached to lignin, forming together with cellulose a highly complex structure. The variable structure and organization of hemicelluloses require the concerted action of many enzymes for its complete degradation. The catalytic modules of hemicellulases are either glycoside hydrolases (GHs) that hydrolyze glycosidic bonds, or carbohydrate esterases (CEs), which hydrolyze ester linkages of acetate or ferulic acid side groups. These catalytic modules, based on homology of their primary sequence, can be assigned into GH and CE families. Some families, with an overall similar fold, can be further grouped into clans, marked alphabetically (e.g., GH-A). A most informative and updated classification of these and other carbohydrate active enzymes is available in the Carbohydrate-Active Enzymes (CAZy) database. Hemicellulolytic enzyme activities can be measured according to Ghose and Bisaria, 1987, *Pure & Appl. Chem.* 59: 1739-1752, at a suitable temperature such as 40° C.–80° C., e.g., 50° C., 55° C., 60° C., 65° C., or 70° C., and a suitable pH such as 4-9, e.g., 5.0, 5.5, 6.0, 6.5, or 7.0.

Use of Xylanases in Step i) in "Method I" or "Method II":

The one or more hemicellulases used in step i) in "Method I" or "Method II" can comprise or consist of one or more xylanases. The one or more xylanases used in step i) in "Method I" or "Method II" can be selected from the group consisting of SEQ ID NO: 4 and SEQ ID NO: 5.

The one or more xylanases used in step i) in "Method I" or "Method II" can have a sequence identity of at least 60% (such as at least 65%, such as at least 70%, such as at least 75%, such as at least 80%, such as at least 85%, such as at least 90%, such as at least 95%, such as at least 99%) with one or more xylanases selected from the group consisting of SEQ ID NO: 4 and SEQ ID NO: 5.

The one or more xylanases used in step i) in "Method I" or "Method II" is further exemplified herein below.

A xylanase, as may optionally be used in the present invention, is an enzyme classified as EC 3.2.1.8. The official name is endo-1,4-beta-xylanase. The systematic name is 1,4-beta-D-xylan xylanohydrolase. Other names may be used, such as endo-(1-4)-beta-xylanase; (1-4)-beta-xylan 4-xylanohydrolase; endo-1,4-xylanase; xylanase; beta-1,4-xylanase; endo-1,4-xylanase; endo-beta-1,4-xylanase; endo-1,4-beta-D-xylanase; 1,4-beta-xylan xylanohydrolase; beta-xylanase; beta-1,4-xylan xylanohydrolase; endo-1,4-beta-xylanase; beta-D-xylanase. The reaction catalysed is the endohydrolysis of 1,4-beta-D-xylosidic linkages in xylans.

According to CAZy(ModO), xylanases are presently classified in either of the following Glycoside Hydrolyase Families: 10, 11, 43, 5, or 8.

In an embodiment, the xylanase is derived from a bacterial xylanase, e.g. a *Bacillus* xylanase, for example from a strain of *Bacillus halodurans, Bacillus pumilus, Bacillus agaradhaerens, Bacillus circulans, Bacillus polymyxa, Bacillus* sp., *Bacillus stearothermophilus*, or *Bacillus subtilis*, including each of the *Bacillus* xylanase sequences entered at the CAZy(ModO) site.

In a further particular embodiment the family 11 glycoside hydrolase is a fungal xylanase. Fungal xylanases include yeast and filamentous fungal polypeptides as defined above, with the proviso that these polypeptides have xylanase activity.

Examples of fungal xylanases of family 11 glycoside hydrolase are those which can be derived from the following fungal genera: *Aspergillus, Aureobasidium, Emericella, Fusarium, Gaeumannomyces, Humicola, Lentinula, Magnaporthe, Neocallimastix, Nocardiopsis, Orpinomyces, Paecilomyces, Penicillium, Pichia, Schizophyllum, Talaromyces, Thermomyces, Trichoderma.*

Examples of species of these genera are listed below in the general polypeptide section. The sequences of xylanase polypeptides deriving from a number of these organisms have been submitted to the databases GenBank/GenPept and SwissProt with accession numbers which are apparent from the CAZy(ModO) site.

A preferred fungal xylanase of family 11 glycoside hydrolases is a xylanase derived from (i) *Aspergillus*, such as SwissProt P48824, SwissProt P33557, SwissProt P55329, SwissProt P55330, SwissProt Q12557, SwissProt Q12550, SwissProt Q12549, SwissProt P55328, SwissProt Q12534, SwissProt P87037, SwissProt P55331, SwissProt Q12568, GenPept BAB20794.1, GenPept CAB69366.1;

(ii) *Trichoderma*, such as SwissProt P48793, SwissProt P36218, SwissProt P36217, GenPept AAG01167.1, GenPept CAB60757.1;

(iii) *Thermomyces* or *Humicola*, such as SwissProt Q43097; or (iv) a xylanase having an amino acid sequence of at least 75% identity to a (mature) amino acid sequence of any of the xylanases of (i)-(iii); or (v) a xylanase encoded by a nucleic acid sequence which hybridizes under low stringency conditions with a mature xylanase encoding part of a gene corresponding to any of the xylanases of (i)-(iii);

(vi) a variant of any of the xylanases of (i)-(iii) comprising a substitution and/or a deletion, and/or an insertion of one or more amino acids;

(vii) an allelic variant of (i)-(iv);

(viii) a fragment of (i), (ii), (iii), (iv) or (vi) that has xylanase activity; or (ix) a synthetic polypeptide designed on the basis of (i)-(iii) and having xylanase activity.

A preferred xylanase is the *Thermomyces* xylanase described in WO 96/23062.

Various *Aspergillus* xylanases are also described in EP 695349, EP 600865, EP 628080, and EP 532533. EP 579672 describes a *Humicola* xylanase.

Preferably, the amino acid sequence of the xylanase has at least 60% identity, preferably at least 65% identity, more preferably at least 70% identity, more preferably at least 75% identity, more preferably at least 80% identity, more preferably at least 85% identity, more preferably at least 90% identity, even more preferably at least 95% identity, and most preferably at least 97% identity to the amino acid sequence of a *Bacillus agaradhaerens* xylanase (such as SEQ ID NO: 4) or the amino acid sequence of a Dictyoglomus *thermophilum* xylanase (such as SEQ ID NO: 5).

In an embodiment, the amino acid sequence of the xylanase has one or several substitutions and/or deletions and/or insertions compared to SEQ ID NO: 4 or SEQ ID NO: 5. In particular, the amino acid sequence of the xylanase is identical to SEQ ID NO: 4 or SEQ ID NO: 5.

Xylanase activity can be measured using any assay, in which a substrate is employed, that includes 1,4-beta-D-xylosidic endo-linkages in xylans. Assay-pH and assay-temperature are to be adapted to the xylanase in question.

Different types of substrates are available for the determination of xylanase activity e.g. Xylazyme cross-linked arabinoxylan tablets (from MegaZyme), or insoluble powder dispersions and solutions of azo-dyed arabinoxylan.

Use of Mannanases in Step i) in "Method I" or "Method II":

The one or more hemicellulases used in step i) in "Method I" or "Method II" can comprise or consist of one or more mannanases. The one or more mannanases used in step i) in "Method I" or "Method II" can be selected from the group consisting of SEQ ID NO: 1, SEQ ID NO: 2, SEQ ID NO: 3, SEQ ID NO: 6 and SEQ ID NO: 7. The one or more mannanases used in step i) in "Method I" or "Method II" has in a preferred embodiment a sequence identity of at least 60% (such as at least 65%, such as at least 70%, such as at least 75%, such as at least 80%, such as at least 85%, such as at least 90%, such as at least 95%, such as at least 99%) with one or more mannanases selected from the group consisting of SEQ ID NO: 1, SEQ ID NO: 2, SEQ ID NO: 3, SEQ ID NO: 6 and SEQ ID NO: 7. The one or more mannanases used in step i) in "Method I" or "Method II" is further exemplified herein below.

The term "mannanase" means a polypeptide having mannan endo-1,4-betamannosidase activity (EC 3.2.1.78) that catalyzes the hydrolysis of 1,4-β-D-mannosidic linkages in mannans, galactomannans and glucomannans. Alternative names of mannan endo-1,4-betamannosidase are 1,4-β-D-mannan mannanohydrolase; endo-1,4-β-mannanase; endo-β-1,4-mannase; β-mannanase B; β-1,4-mannan 4-mannanohydrolase; endo-β-mannanase; and β-D-mannanase. For purposes of the present invention, mannanase activity may be determined using the Reducing End Assay as described in the experimental section. In one aspect, the polypeptides of the present invention have at least 20%, e.g., at least 40%, at least 50%, at least 60%, at least 70%, at least 80%, at least 90%, at least 95%, or at least 100% of the mannanase activity of the mature polypeptide of SEQ ID NO: 1 and/or the mature polypeptide of SEQ ID NO: 2 and/or the mature polypeptide of SEQ ID NO: 3 and/or the mature polypeptide of SEQ ID NO: 6 and/or the mature polypeptide of SEQ ID NO: 7.

In a further embodiment the one or more hemicellulases used in step i) in "Method I" or "Method II" can comprise one or more xylanases and one or more mannanases.

Temperature Used in Step i) in "Method I" or "Method II":

The temperature used for step i) in "Method I" or "Method II" is typically from 20° C. to 100° C. such as a temperature interval selected from the group consisting of from 20° C. to 30° C., from 30° C. to 40° C., from 40° C. to 50° C., from 50° C. to 60° C., from 60° C. to 70° C., from 70° C. to 80° C., from 80° C. to 90° C., from 90° C. to 100° C., or any combination of these intervals.

Incubation Time Used in Step i) in "Method I" or "Method II":

The incubation time used for step i) in "Method I" or "Method II" is typically from 5 minutes to 6 hours such as a time interval selected from the group consisting of from 5 minutes to 15 minutes, from 15 minutes to 30 minutes, from 30 minutes to 45 minutes, from 45 minutes to 60 minutes, from 1 hour to 1.5 hours, from 1.5 hours to 2 hours, from 2 hours to 2.5 hours, from 2.5 hours to 3 hours, from 3 hours to 3.5 hours, from 3.5 hours to 4 hours, from 4 hours to 4.5 hours, from 4.5 hours to 5 hours, from 5 hours to 5.5 hours, from 5.5 hours to 6 hours, or any combination of these time intervals.

Enzyme Concentration Used in Step i) in "Method I" or "Method II":

The concentration of the one or more hemicellulases used in step i) in "Method I" or "Method II" can in one embodiment be from 0.05 mg/kg oven dry pulp to 100 mg/kg oven dry pulp such as a concentration selected from the group consisting of from 0.05 mg/kg oven dry pulp to 0.25 mg/kg oven dry pulp, from 0.25 mg/kg oven dry pulp to 1.0 mg/kg oven dry pulp, from 1.0 mg/kg oven dry pulp to 5.0 mg/kg oven dry pulp, from 5.0 mg/kg oven dry pulp to 10.0 mg/kg oven dry pulp, from 10.0 mg/kg oven dry pulp to 15.0 mg/kg oven dry pulp, from 15.0 mg/kg oven dry pulp to 20.0 mg/kg oven dry pulp, from 20.0 mg/kg oven dry pulp to 30.0 mg/kg oven dry pulp, from 30.0 mg/kg oven dry pulp to 40.0 mg/kg oven dry pulp, from 40.0 mg/kg oven dry pulp to 60.0 mg/kg oven dry pulp, from 60.0 mg/kg oven dry pulp to 80.0 mg/kg oven dry pulp, and from 80.0 mg/kg oven dry pulp to 100.0 mg/kg oven dry pulp, or any combination of these intervals.

Hot Caustic Extraction (HCE) in Step ii) in "Method I" or "Method II":

Hot Caustic Extraction (HCE) is a method to remove short chain hemicellulose and amorphous cellulose in pulps. In a (HCE)-stage the NaOH-concentration is not as high as in a cold alkali treatment, but the temperature is higher.

The temperature in HCE in step ii) in "Method I" or "Method II" is preferably from 70° C. and 160° C. In a preferred embodiment the HCE temperature can be within a temperature interval selected from the group consisting of from about 70° C. to about 75° C., from about 75° C. to about 80° C., from about 80° C. to about 85° C., from about 85° C. to about 90° C., from about 90° C. to about 95° C., from about 95° C. to about 100° C., from about 100° C. to about 105° C., from about 105° C. to about 110° C., from about 110° C. to about 115° C., from about 115° C. to about 120° C., from about 120° C. to about 125° C., from about 125° C. to about 130° C., from about 130° C. to about 135° C., from about 135° C. to about 140° C., from about 140° C. to about 145° C., from about 145° C. to about 150° C., from about 150° C. to about 155° C., and from about 155° C. to about 160° C., or any combination of these intervals. If a temperature of 100° C. or above 100° C. is used the reaction is preferably performed at a pressure above atmospheric pressure such as at a pressure selected from the group consisting of pressure intervals from 1-2 bars, 2-3 bars, 3-4 bars, 4-5 bars, 5-6 bars, 6-7 bars, 7-8 bars, 8-9 bars or 9-10 bars or 10-12 bars or any combination of these intervals.

In a preferred embodiment the alkali source used in step ii) in "Method I" or "Method II" consists of or comprises NaOH. In another embodiment the alkali source used in step ii) consists of or comprises one or more alkali sources selected from the group consisting of NaOH $Ca(OH)_2$, $NH_4OH$ and $Mg(OH)_2$.

The hot caustic extraction in step ii) in "Method I" or "Method II" is in a preferred embodiment performed with an alkaline source (such as NaOH) at a concentration in the liquid phase of less than 2 w/w %, such as less than 1.8 w/w %, such as less than 1.6 w/w %, such as less than 1.4 w/w %, such as less than 1.2 w/w %, such as less than 1.0 w/w %, such as less than 0.8 w/w %, such as less than 0.6 w/w %, such as less than 0.4 w/w %, such as less than 0.2 w/w %, or such as less than 0.15 w/w %.

The hot caustic extraction in step ii) in "Method I" or "Method II" is in a preferred embodiment performed with an alkaline source (such as NaOH) consisting of or comprising hydroxide ions (such as NaOH) and the HCE is performed at a concentration of hydroxide ions in the liquid phase of less than 1 M, such as less than 0.9 M, such as less than 0.8 M, such as less than 0.7 M, such as less than 0.6 M, such as less than 0.5 M, such as less than 0.4 M, such as less than 0.3 M, such as less than 0.2 M, such as less than 0.1 M, such as less than 0.09 M, such as less than 0.08 M, such as less than 0.07 M, such as less than 0.06 M, such as less than 0.05 M, such as less than 0.04 M, such as less than 0.03 M and such as less than 0.02 M.

The NaOH concentration in the liquid phase used in the HCE in step ii) in "Method I" or "Method II" is typically less than 2 w/w %, such as less than 1.8 w/w %, such as less than 1.6 w/w %, such as less than 1.4 w/w %, such as less than 1.2 w/w %, such as less than 1.0 w/w %, such as less than 0.8 w/w %, such as less than 0.6 w/w %, such as less than 0.4 w/w %, such as less than 0.2 w/w %, or such as less than 0.15 w/w %.

The hot caustic extraction in step ii) in "Method I" or "Method II" is in a preferred embodiment performed with NaOH as the alkaline source and the HCE is performed at a concentration of NaOH in the liquid phase of less than 1 M, such as less than 0.9 M, such as less than 0.8 M, such as less than 0.7 M, such as less than 0.6 M, such as less than 0.5 M, such as less than 0.4 M, such as less than 0.3 M, such as less than 0.2 M, such as less than 0.1 M, such as less than 0.09 M, such as less than 0.08 M, such as less than 0.07 M, such as less than 0.06 M, such as less than 0.05 M, such as less than 0.04 M, such as less than 0.03 M and such as less than 0.02 M.

The hot caustic extraction in step ii) in "Method I" or "Method II" is in a preferred embodiment performed with an alkaline source (such as NaOH) at a concentration in the liquid phase-selected from the group consisting of from 0.1 w/w % to 0.2 w/w %, from 0.2 w/w % to 0.4 w/w %, from 0.4 w/w % to 0.6 w/w %, from 0.6 w/w % to 0.8 w/w %, from 0.8 w/w % to 1.0 w/w %, from 1.0 w/w % to 1.2 w/w %, from 1.2 w/w % to 1.4 w/w %, from 1.4 w/w % to 1.6 w/w %, from 1.6 w/w % to 1.8 w/w %, from 1.8 w/w % to 2.0 w/w %, or any combination of these intervals ( ).

The hot caustic extraction in step ii) in "Method I" or "Method II" is in a preferred embodiment performed with a NaOH concentration in the liquid phase selected from the group consisting of from 0.1 w/w % to 0.2 w/w %, from 0.2 w/w % to 0.4 w/w %, from 0.4 w/w % to 0.6 w/w %, from 0.6 w/w % to 0.8 w/w %, from 0.8 w/w % to 1.0 w/w %, from 1.0 w/w % to 1.2 w/w %, from 1.2 w/w % to 1.4 w/w %, from 1.4 w/w % to 1.6 w/w %, from 1.6 w/w % to 1.8 w/w %, from 1.8 w/w % to 2.0 w/w %, or any combination of these intervals().

The hot caustic extraction in step ii) in "Method I" or "Method II" is in a preferred embodiment performed with an alkaline source (such as NaOH) at a concentration in the liquid phase of hydroxide ions selected from the group consisting of from 0.01 M to 0.025 M, from 0.025 M to 0.05 M, from 0.05 M to 0.1 M, from 0.1 M to 0.2 M, from 0.2 M to 0.3 M, from 0.3 M to 0.4 M, from 0.4 M to 0.5 M and from 0.5 M to 1 M, or any combination thereof.

The retention time for the HCE in step ii) in "Method I" or "Method II" is typically from 15 minutes to 5 hours. In a preferred embodiment the HCE retention time is within a time interval selected from the group consisting of from 15 minutes to 30 minutes, from 30 minutes to 45 minutes, from 45 minutes to 1 hour, from 1 hour to 1.5 hours, from 1.5 hour to 2 hours, from 2 hour to 2.5 hours, from 2.5 hour to 3 hours, from 3 hour to 3.5 hours, from 3.5 hour to 4 hours, from 4 hour to 4.5 hours, and from 4.5 hour to 5 hours, or any combination of these intervals.

Typical pulp consistencies used for the (HCE)-stage in step ii) in "Method I" or "Method II" is within the range between 2% and 30%. Preferably the pulp consistency used for the HCE in step ii) in "Method I" or "Method II" is from 5% to 20%, such as from 10% to 15%. In a preferred embodiment the pulp consistency used for HCE in step ii) in "Method I" or "Method II" is within an interval selected from the group consisting of from 2% to 4%, from 4% to 6%, from 6% to 8%, from 8% to 10%, from 10% to 12%, from 12% to 14%, from 14% to 16%, from 16% to 18%, from 18% to 20%, from 20% to 22%, from 22% to 24%, from 24% to 26%, from 26% to 28%, and from 28% to 30%, or any combination of these intervals.

Pulp Used and Produced in the Method According to the Invention:

The paper-grade pulp used in the present invention can be wood pulp coming e.g. from softwood trees (such as spruce, pine, fir, larch and hemlock) and/or hardwoods (such as *eucalyptus*, aspen and birch) or other plant sources such as bamboo.

In a preferred embodiment the paper-grade alkaline pulp is selected from the group consisting of paper-grade kraft hardwood pulp, paper-grade kraft softwood pulp, paper-grade soda hardwood pulp or paper-grade soda softwood pulp and any mixture thereof.

In a preferred embodiment the hemicellulose content of the dissolving-grade pulp produced according to the invention is less than 10%, such as less than 9%, such as less than 8%, such as less than 7%, such as less than 6%, such as less than 5%, such as less than 4%, such as less than 3%, such as less than 2% or such as less than 1%.

The invention relates in one embodiment to a pulp such as a dissolving-grade pulp made by the method according to the invention.

The invention further relates to use of the dissolving-grade pulp according to the invention for production of textile fibers. The dissolving-grade pulp produced may be used in the manufacture of regenerated cellulose such as viscose rayon, lyocell and modal fibers.

The invention further relates to use of the dissolving-grade pulp according to the invention for production of derivatized celluloses (cellulose derivatives) such as cellulose esters and ethers.

Performing "Method I" or "Method II" in the Presence of One or More Surfactants

Step i) and/or step ii) in Method I or "Method II" can be performed in the presence of one or more surfactants such as one or more anionic surfactants and/or one or more nonionic surfactants and/or one or more cationic surfactants.

Surfactants can in one embodiment include poly(alkylene glycol)-based surfactants, ethoxylated dialkylphenols, ethoxylated dialkylphenols, ethoxylated alcohols and/or silicone based surfactants.

Examples of poly(alkylene glycol)-based surfactant are poly(ethylene glycol) alkyl ester, poly(ethylene glycol) alkyl ether, ethylene oxide/propylene oxide homo- and copolymers, or poly(ethylene oxide-co-propylene oxide) alkyl esters or ethers. Other examples include ethoxylated derivatives of primary alcohols, such as dodecanol, secondary alcohols, poly[propylene oxide], derivatives thereof, tridecylalcohol ethoxylated phosphate ester, and the like.

Specific presently preferred anionic surfactant materials useful in the practice of the invention comprise sodium alpha-sulfo methyl laurate, (which may include some alpha-sulfo ethyl laurate) for example as commercially available under the trade name ALPHA-STEP™-ML40; sodium xylene sulfonate, for example as commercially available under the trade name STEPANATE™-X; triethanolammonium lauryl sulfate, for example as commercially available under the trade name STEPANOL™-WAT; diosodium lauryl sulfosuccinate, for example as commercially available under the trade name STEPAN™-Mild SL3; further blends of various anionic surfactants may also be utilized, for example a 50%-50% or a 25%-75% blend of the aforesaid ALPHA-STEP™ and STEPANATE™ materials, or a 20%-80% blend of the aforesaid ALPHA-STEP™ and STEPANOL™ materials (all of the aforesaid commercially available materials may be obtained from Stepan Company, Northfield, Ill.).

Specific presently preferred nonionic surfactant materials useful in the practice of the invention comprise cocodiethanolamide, such as commercially available under trade name NINOL™-11CM; alkyl polyoxyalkylene glycol ethers, such as relatively high molecular weight butyl ethylenoxide-propylenoxide block copolymers commercially available under the trade name TOXIMUL™-8320 from the Stepan Company. Additional alkyl polyoxyalkylene glycol ethers may be selected, for example, as disclosed in U.S. Pat. No. 3,078,315. Blends of the various nonionic surfactants may also be utilized, for example a 50%-50% or a 25%-75% blend of the aforesaid NINOL™ and TOXIMUL™ materials.

Specific presently preferred anionic/nonionic surfactant blends useful in the practice of the invention include various mixtures of the above materials, for example a 50%-50% blends of the aforesaid ALPHA-STEP™ and NINOL™ materials or a 25%-75% blend of the aforesaid STEPANATE™ and TOXIMUL™ materials.

Preferably, the various anionic, nonionic and anionic/nonionic surfactant blends utilized in the practice of the invention have a solids or actives content up to about 100% by weight and preferably have an active content ranging from about 10% to about 80%. Of course, other blends or other solids (active) content may also be utilized and these anionic surfactants, nonionic surfactants, and mixtures thereof may also be utilized with known pulping chemicals such as, for example, anthraquinone and derivatives thereof and/or other typical paper chemicals, such as caustics, defoamers and the like.

Preferred Embodiments

Preferred embodiments of the invention are described in the set of items herein below.

1. A method for removal of hemicelluloses from paper-grade alkaline pulp comprising the steps of i) treating the paper-grade alkaline pulp with one or more hemicellulases;
   ii) performing hot caustic extraction of the paper-grade alkaline pulp with an alkaline source at a temperature from 70° C. to 160° C. and at alkaline conditions of from 0.01 M to 1 M hydroxide ions;
   iii) optionally bleaching the pulp obtained in step i) and/or ii) in one or more bleaching steps if ISO brightness of the pulp is below 90% (e.g. with one or more D stage);

and thereby removing at least 20% of the hemicelluloses from the paper-grade alkaline pulp.
2. A method for removal of hemicelluloses from paper-grade alkaline pulp comprising the steps of i) treating the paper-grade alkaline pulp with one or more hemicellulases (X stage);

ii) performing hot caustic extraction of the paper-grade alkaline pulp using an alkaline source at a temperature from 70° C. to 160° C. and alkaline conditions of from 0.01 M to 1 M hydroxide ions (HCE stage);

iii) optionally bleaching of the pulp obtained in step i) and/or ii) in one or more bleaching steps if ISO brightness of the pulp is below 90% (D stage);

iv) optionally repeating step i) and/or ii) (one or more times) if the pulp obtained in step i) and/or ii) contains more than 10% hemicelluloses;

and thereby generating dissolving pulp contains less than 10% hemicelluloses.

3. The method according to item 1 or 2, wherein the one or more hemicellulases used in step i) comprise or consist of one or more xylanases.

4. The method according to any of items 1-3, wherein the one or more hemicellulases used in step i) comprise or consist of one or more mannanases.

5. The method according to any of items 1 to 4, wherein the paper-grade alkaline pulp is softwood pulp or a mixture of softwood and hardwood pulp and wherein the one or more hemicellulases comprises or consists of one or more xylanases and one or more mannanases.

6. The method according to any of items 1 to 5, wherein the method comprises a sequence of stages selected from the group consisting of X-HCE, X-D-HCE, X-D-HCE-X-HCE-D, X-D-HCE-XD-HCE-D, X-Z-HCE, X-D-HCE-X-HCE-Z, X-Z-HCE-X-HCE-D, X-Paa-HCE, X-D-HCE-X-HCE-Paa and X-Paa-HCE-X-HCE-D.

7. The method according to item 3 or 5, wherein the one or more xylanases used in step i) can be selected from the group consisting of SEQ ID NO: 4 and SEQ ID NO: 5.

8. The method according to item 3 or 5, wherein the one or more xylanases used in step i) has a sequence identity of at least 60% [such as at least 65%, such as at least 70%, such as at least 75%, such as at least 80%, such as at least 85%, such as at least 90%, such as at least 95%, such as at least 99%] to one or more xylanases selected from the group consisting of SEQ ID NO: 4 and SEQ ID NO: 5.

9. The method according to item 4 or 5, wherein the one or more mannanases used in step i) can be selected from the group consisting of SEQ ID NO: 1, SEQ ID NO: 2, SEQ ID NO: 3, SEQ ID NO: 6 and SEQ ID NO: 7.

10. The method according to item 4 or 5, wherein the one or more mannanases used in step i) has a sequence identity of at least 60% [such as at least 65%, such as at least 70%, such as at least 75%, such as at least 80%, such as at least 85%, such as at least 90%, such as at least 95%, such as at least 99%] with one or more mannanases selected from the group consisting of SEQ ID NO: 1, SEQ ID NO: 2, SEQ ID NO: 3, SEQ ID NO: 6 and SEQ ID NO:7.

11. The method according to any of items 1-10, wherein the one or more hemicellulases used in step i) comprise one or more xylanases and one or more mannanases.

12. The method according to any of items 1-11, wherein concentration of the one or more hemicellulases used in step i) is from 0.05 mg/kg oven dry pulp to 100 mg/kg oven dry pulp.

13. The method according to any of items 1-12, wherein the alkali source used in step ii) consists of or comprises NaOH.

14. The method according to any of items 1-13, wherein the alkali source used in step ii) consists of or comprises one or more alkali sources selected from the group consisting of NaOH Ca(OH)2, $NH_4OH$ and $Mg(OH)_2$.

15. The method according to any of items 1-14, wherein the hot caustic extraction in step ii) is performed with a NaOH concentration of less than 0.75 M, such as less than 0.5 M, such as less than 0.25 M or such as less than 0.1 M.

16. The method according to any of items 1-15, wherein the hot caustic extraction in step ii) is performed at a temperature between 80° C. and 130° C.

17. The method according to item 16, wherein the hot caustic extraction in step ii) is performed at a temperature between 90° C. and 110° C.

18. The method according to any of items 1-17, wherein the paper-grade alkaline kraft pulp is selected from the group consisting of alkaline hardwood pulp, alkaline softwood pulp, kraft pulp, hardwood kraft pulp, softwood kraft pulp, soda pulp, hardwood soda pulp and softwood soda pulp, or any mixture thereof.

19. The method according to any of items 1-18, wherein the hemicellulose content of the generated dissolving is less than 10%, such as less than 9%, such as less than 8%, such as less than 7%, such as less than 6%, such as less than 5%, such as less than 4%, such as less than 3%, such as less than 2% or such as less than 1%.

20. The method according to any of items 1-19, wherein step i) is performed prior to step ii).

21. The method according to any of items 1-20, wherein the method results in removal of at least 25%, at least 30%, at least 35%, at least 40%, at least 45% or at least 50% of the hemicelluloses from the paper-grade alkaline pulp.

22. The method according to any of items 1-21, wherein the method further comprises performing Cold Caustic Extraction of the paper-grade alkaline pulp or the dissolving pulp with an alkaline source at a temperature from 10° C. to 50° C. (such as 20° C. to 40° C.) and at alkaline conditions of from 1.0 M to 3 M hydroxide ions 23. The method according to item 22, wherein the Cold Caustic Extraction is performed after the hemicellulase treatment and after the hot caustic extraction.

24. The method according to any of items 1-23, wherein a D stage is performed between step i) and ii).

25. The method according to any of items 1-24 further comprising an Acid stage (e.g. using the following conditions: 80-120° C., pH 2-4.5, from 5 min to 180 minutes preferably using $H_2SO_4$).

26. A dissolving-grade pulp made by the method according to any of items 1-25.

27. A textile fiber made of the dissolving pulp according to item 26.

28. Use of the dissolving-grade pulp according to item 26 for production of textile fibers.

29. Use of the dissolving-grade pulp according to item 26 for production of derivatized celluloses.

EXAMPLES

Example 1

Effect of a Xylanase Treatment in Xylan Removal from a Bleached Northern Mixed Hardwood Kraft Paper-Grade Pulp Bleached northern mixed hardwood kraft pulp in sheet form (dry lap market paper-grade pulp) was soaked in water and disintegrated in a pulp disintegrator (10000 rpm) and then filtered before being used in the experiments. The pulp was then treated with a xylanase (SEQ ID NO: 5; denoted as X-stage) at 10% consistency, 75° C. and pH 4.5 (acetate buffer) for 4 h using 20 mg enzyme protein (EP)/kg odp (oven-dry pulp; dry matter basis). The pulp suspension was incubated in sealed polyethylene plastic bags immersed in a temperature controlled water bath. After incubation, the pulp was filtered and the filtrate collected. The pulp was then washed and filtered in three consecutive steps with 2 L of warm tap water and 1 L of deionized water. Control experiments were run in parallel under exactly the same conditions except for the use of xylanase.

Part of the washed pulp was then oven-dried at 40° C. and was grinded using a MF 10 basic Microfine grinder drive (IKA) coupled with a cutting-grinding head and a sieve of 2 mm for particle size filtering.

The grinded pulp was used to assess its monossacharide composition after sulfuric acid hydrolysis according to the corresponding description found in NREL Laboratory Analytical Procedure "Determination of Structural Carbohydrates and Lignin in Biomass" (NREL/TP-510-42618). The pulp hydrolysates were analysed by high-performance anion exchange chromatography with pulsed amperometric detection (HPAEC-PAD) using a CarboPac 1 column and as eluents 0.5 M NaOH (for regeneration of the column) and 50 mM NaOH (4% for 30 min). Monosaccharides were quantified after suitable dilutions against a 5-point standard curve of arabinose (Ara), galactose (Gal), glucose (Glc) and mannose (Man) between 0.002-0.02 g/L.

The results presented regarding monosaccharide composition in Table 1 and in the remainder are the relative percentage (w/w; polymeric sugar concentration) corresponding to the major monossacharides contained in the northern mixed bleached hardwood pulp. It is observed a modest decrease in the content of xylose in the bleached mixed hardwood kraft pulp after the xylanase treatment.

TABLE 1

| | Monossacharide composition (% w/w) | |
|---|---|---|
| Pulp ID | glucose | xylose |
| Original paper-grade pulp (no treatment) | 78.0 | 22.0 |
| Control treated pulp (no enzyme) | 78.0 | 22.0 |
| Xylanase treated pulp | 80.0 | 20.0 |

Example 2

Effect of a Xylanase Treatment Combined with Hot Caustic Extraction in Xylan Removal from a Mixed Hardwood Kraft Paper-Grade Pulp The same pulps produced in Example 1 (control and xylanase treated) were further submitted to a hot alkaline extraction (HCE) stage at 10% consistency, 95° C. for 2 h and using different NaOH dosages. The NaOH dosages are presented both in terms of the dry-matter content (% odp—oven dry pulp) and in terms of NaOH concentration in the liquid phase of the pulp suspension at 10% consistency. After treatment, the filtrates were collected and the pulps were thoroughly washed with hot tap water. The pulps were then dried in the oven at 40° C. as described in Example 1.

The alkaline extraction performance was firstly evaluated based on the COD (chemical oxygen demand) of the pulp filtrates as shown in Table 2. The COD determination was performed using a COD Cell Test from Merck. The reaction cells with the diluted filtrate were put in a thermo reactor at 148° C. for 2 h and then allowed to cool down before measurement in the photometer NOVA 60 within 60 min after the reaction.

In Table 2 it is observed a clear synergy with regard to the combination of the xylanase and HCE treatment on the amount of COD generated. This is further confirmed in Table 3 in terms of monossacharide composition of the HCE-treated pulps using 4% odp NaOH (0.111 M or 4.44 g/L), where a clear synergy between the xylanase treatment (X-stage) and the hot caustic extraction (HCE-stage) is visible: the X-HCE treatment with 4% odp NaOH allows a high amount of xylan removal down to 13.4% (ca. 39% removal) when compared to the control treatment where it almost did not affect its xylan content. A further decrease in the amount of xylan can be anticipated if the treatment is repeated as illustrated in Examples 6 and 7 for the cases of oxygen-delignified hardwood pulp and unbleached softwood pulp where longer sequences comprising X and HCE treatments resulted in less then 10% of residual hemicelluloses in pulp.

TABLE 2

| | COD in the pulp filtrate after HCE-stage (mg/mL) | |
|---|---|---|
| NaOH dosage in HCE-stage | Control pulp | Xylanase treated pulp |
| 2% odp (0.056M) | 2250 | 4970 |
| 4% odp (0.111M) | 3340 | 7300 |
| 6% odp (0.167M) | 4620 | 9340 |

TABLE 3

| | Monossacharide composition (% w/w) | |
|---|---|---|
| Pulp ID | glucose | Xylose |
| Control - HCE 4% NaOH odp (0.111M) | 78.1 | 21.9 |
| X stage - HCE 4% NaOH odp (0.111M) | 86.6 | 13.4 |

Example 3

Effect of a Xylanase Treatment Combined with HCE in Xylan Removal from a Chlorine Dioxide Delignified Northern Mixed Hardwood Kraft Paper-Grade Pulp (Partially Bleached with O-$D_0$-Stages): O-$D_0$-X-HCE Sequence A previously oxygen and chlorine dioxide delignified northern mixed hardwood kraft pulp (O-$D_0$-pulp; paper-grade pulping and bleaching process) was treated with xylanase (SEQ ID NO: 5) under the same conditions as in Example 1. The control and the xylanase treated pulp was further treated with HCE as described in Example 2 but using 6% odp NaOH (0.167 M or 6.67 g/L) and 12% odp NaOH (0.333 M or 13.3 g/L) and higher temperatures.

In the cases where higher temperature than 95° C. were used, the HCE treatments were conducted in steel beakers that were pressurized at room temperature with $N_2$ until 1.5 and 2.0 bar for the experiments at 105° C. and 115° C., respectively. These beakers were placed inside the Labomat BFA-24 (Werner Mathis AG, Switzerland) which is an instrument that allows controlling temperature, mechanical agitation and treatment time of the reaction systems in the beakers. The instrument is controlled by the Univision S software (Univision S "BFA" Programming Instruction, version 2.0 edition 07/2006 by Werner Mathis AG, Switzerland). Beaker temperature is increased by heat transfer from an infrared-radiation unit. Beakers are cooled down by cooling the air in a heat exchanger with a cooling water supply.

The results presented in Table 4 show that xylan is removed from this pulp until a limit of ca. 10.1% (ca. 43% removal). As this original pulp is only partially bleached with O-$D_0$ stages, it is required more bleaching stages (e.g. D, P, Paa, Z or Y) combined with X and HCE purification thus allowing reaching levels of hemicelluloses below 10%, as described in Examples 6 and 7.

TABLE 4

| Pulp ID | Monossacharide composition (% w/w) glucose | xylose |
|---|---|---|
| Original O-$D_0$-pulp (no treatment) | 82.2 | 17.8 |
| Control treated pulp (no enzyme) | 82.1 | 17.9 |
| Xylanase treated pulp (X-stage) | 85.5 | 14.5 |
| Control - HCE 6% odp NaOH (0.167M) 95° C. | 83.1 | 16.9 |
| X stage - HCE 6% odp NaOH (0.167M) 95° C. | 88.6 | 11.4 |
| Control - HCE 12% odp NaOH (0.333M) 95° C. | 83.6 | 16.4 |
| X stage - HCE 12% odp NaOH (0.333M) 95° C. | 88.8 | 11.2 |
| Control - HCE 6% odp NaOH (0.167M) 105° C. | 83.8 | 15.9 |
| X stage - HCE 6% odp NaOH (0.167M) 105° C. | 89.6 | 10.2 |
| Control - HCE 6% odp NaOH (0.167M) 115° C. | 83.9 | 15.8 |
| X stage - HCE 6% odp NaOH (0.167M) 115° C. | 89.6 | 10.1 |

Example 4

Effect of a Xylanase Treatment Combined with HCE in Xylan Removal from an Oxygen Delignified *Eucalyptus* Kraft Paper-Grade Pulp (Partially Bleached with a O-Stage): O-X-HCE Sequence A hardwood eucalypt kraft pulp after oxygen delignification was submitted to the same X-HCE treatment as described in the previous examples. In this case, it was possible to reach a xylan content down to 8.5% (ca. 39% removal) as shown in Table 5.

TABLE 5

| Pulp ID | Monossacharide composition (% w/w) glucose | xylose |
|---|---|---|
| Original $O_2$-kraft pulp | 85.5 | 14.5 |
| Control treated pulp (no enzyme) | 85.4 | 14.6 |
| Xylanase treated pulp | 89.3 | 10.7 |
| Control - HCE 12% odp NaOH (0.333M) 95° C. | 85.8 | 14.2 |
| X stage - HCE 12% odp NaOH (0.333M) 95° C. | 91.2 | 8.8 |

Example 5

Effect of a Xylanase Treatment Combined with Hot Alkaline Extraction Stages and Chlorine Dioxide Stages in the Bleaching and Purification of an Oxygen Delignified *Eucalyptus* Kraft Paper-Grade Pulp (Partially Bleached with an O-Stage): O-X-$D_0$-HCE Sequence An eucalypt kraft pulp after oxygen delignification was submitted to a sequence of treatments in the following order: X-$D_0$-HCE. The X-stage conditions were the same as described in Example 1. The chlorine dioxide treatment ($D_0$-stage) was done at 10% consistency in plastic bags using 1.10% odp $ClO_2$, 80° C., initial pH of 2.5 (adjusted with sulfuric acid) for 90 min. The HCE-stage was performed as before at 95° C. and using 6 and 12% odp NaOH, designated by HCE6 and HCE12, respectively.

The results presented in Table 6 show that it was possible to reach 9.5% of xylan left in the pulp after O-X-$D_0$-HCE sequence confirming the possibility of applying the combination of X and HCE in a more flexible way by having bleaching stages in between the X and HCE treatments for pulp purification (removal of hemicelluloses). This result could be further improved by repeating treatment, for example using X-HCE and possibly comprising a bleaching stage, as described in Examples 6 and 7.

TABLE 6

| Pulp ID | Monossacharide composition (% w/w) glucose | xylose |
|---|---|---|
| Control - $D_0$ - HCE6 | 83.8 | 16.2 |
| X-stage - $D_0$ - HCE6 | 89.9 | 10.1 |
| Control - $D_0$ - HCE12 | 83.9 | 16.1 |
| X-stage - $D_0$ - HCE12 | 90.5 | 9.5 |

Example 6

Effect of a Xylanase Treatment Before and within the Pulp Bleaching Process of an Oxygen Delignified *Eucalyptus* Kraft Paper-Grade Pulp (Partially Bleached with a O-Stage) on Bleaching and Purification (Xylan Removal): O-X-$D_0$-HCE-X-HCE-$D_1$ Sequence The same eucalypt kraft pulp as in Example 5 was treated with the following sequence of stages at 10% consistency: X-$D_0$-HCE-X-HCE-$D_1$. The X and $D_0$ stages were conducted as in Example 5 but using two dosages of enzyme protein (EP) in the X-stages: 10 and 20 mg EP/kg odp. The hot caustic extraction stages were run at two different temperatures, two different dosages of NaOH and with or without the addition of hydrogen peroxide. The HCE2 and HCE6 stages were run as before in Example 2 at 95° C. for 2 h and using 2 and 6% odp NaOH, respectively. In addition, HCE-stages were run at 85° C. for 2 h, using 1% odp NaOH with or without the co-addition of hydrogen peroxide (0.5% $H_2O_2$ odp), HCE1p and HCE1 respectively. In the last chlorine dioxide treatment ($D_1$-stage) it was used 0.4% odp $ClO_2$, pH 4.5-5.0 (adjusted with sulfuric acid), 80° C. for 2 h. After each stage, the pulps were thoroughly washed as described in the previous examples.

Pulp handsheets were prepared according to ISO 3688 for the measurement of the "ISO brightness" (diffuse blue reflectance factor; ISO 2470-1) and using a Color Touch PC spectrophotometer from Technidyne.

In Table 7, it is seen that up to ca. 53% of the xylan was removed from the pulp by using the sequences of stages comprising HCE stages at higher temperature and higher dosage of NaOH (HCE2 and HCE6) thereby reaching a level of 8.0% xylan in the fully bleached pulp. In terms of the final brightness of the bleached pulps, all the xylanase treated pulps exhibit much higher brightness than the controls without enzyme addition. When hydrogen peroxide is not added in the HCE stage, the difference between the xylanase treated pulp and the control is very high (up to 4.5 ISO brightness units) while reaching values≥91% ISO brightness with xylanase addition.

TABLE 7

| Pulp ID | ISO brightness (%) | Monossacharide composition (% w/w) glucose | xylose |
|---|---|---|---|
| Original eucalypt $O_2$-kraft pulp | 51.4 | 82.9 | 17.1 |
| O-Control-$D_0$-HCE2-Control-HCE2-$D_1$ | 86.9 | 85.0 | 15.0 |
| O-X-$D_0$-HCE2-X-HCE2-$D_1$ X: 20 mg EP/kg odp | 91.3 | 92.0 | 8.0 |
| O-X-$D_0$-HCE2-X-HCE2-$D_1$ X: 10 mg EP/kg odp | 91.4 | 91.8 | 8.2 |
| O-Control-$D_0$-HCE6-Control-HCE6-$D_1$ | 86.9 | 85.3 | 14.7 |
| O-X-$D_0$-HCE6-X-HCE6-$D_1$ X: 20 mg EP/kg odp | 91.0 | 92.0 | 8.0 |
| O-X-$D_0$-HCE6-X-HCE6-$D_1$ X: 10 mg EP/kg odp | 91.0 | 91.4 | 8.6 |
| O-Control-$D_0$-HCE1-Control-HCE1-$D_1$ | 87.8 | 84.9 | 15.1 |
| O-X-$D_0$-HCE1-X-HCE1-$D_1$ X: 20 mg EP/kg odp | 92.1 | 91.0 | 9.0 |
| O-X-$D_0$-HCE1-X-HCE1-$D_1$ X: 10 mg EP/kg odp | 92.0 | 90.2 | 9.8 |
| O-Control-$D_0$-HCE1p-Control-HCE1p-$D_1$ | 92.0 | 85.1 | 14.9 |
| O-X-$D_0$-HCE1p-X-HCE1p-$D_1$ X: 20 mg EP/kg odp | 93.7 | 90.8 | 9.2 |
| O-X-$D_0$-HCE1p-X-HCE1p-$D_1$ X: 10 mg EP/kg odp | 93.8 | 90.2 | 9.8 |

C., initial pH of 2.8 (adjusted with sulfuric acid) for 1 h. The $D_1$-stage used 1.50% odp $ClO_2$, 80° C., initial pH of 4.0 (adjusted with sulfuric acid) for 3 h while the $D_2$-stage had 0.4% odp $ClO_2$, 70° C., initial pH of 4.0 (adjusted with sulfuric acid) for 3 h. The HCE-stages were performed as before at 95° C. and using 2 and 6% odp NaOH, designated by HCE2 and HCE6, respectively.

The amount of hemicelluloses in the final bleached pulp reached a level of 7.6% when using the sequence comprising the enzyme stages with xylanase and mannanase combined with HCE6, which represents a removal of 52% of hemicelluloses (xylan and mannan) from the original pulp. An additive effect is seen when combining the xylanase with the mannanase in terms of the extent of xylan and mannan removal and of the final ISO brightness of the bleached pulp when compared to their performance alone. This indicates that for softwood pulps it is important to have both a xylanase and a mannanase in the enzyme-stage (X+M) in order to remove hemicelluloses to a significant extent and upgrade the original paper-pulp into dissolving pulp. This is seen in Table 6 where less than 10% hemicelluloses is reached by such approach comprising (X+M) and HCE purification stages. In fact, for this pulp the sequences with HCE6-stages were more efficient regarding the extent of hemicelluloses removal compared to the sequences with HCE2-stages.

TABLE 8

| Pulp ID | ISO brightness (%) | Monossacharide composition (% w/w) glucose | xylose | Mannose | Hemicelluloses (% w/w) |
|---|---|---|---|---|---|
| Original softwood kraft pulp | 29.1 | 84.2 | 8.7 | 7.1 | 15.8 |
| Control-$D_0$-HCE2-Control-$D_1$-HCE2-$D_2$ | 88.1 | 86.2 | 7.1 | 6.8 | 13.8 |
| X-$D_0$-HCE2-X-$D_1$-HCE2-$D_2$ X: 20 mg EP/kg odp | 90.0 | 88.8 | 4.2 | 7.0 | 11.2 |
| M-$D_0$-HCE2-M-$D_1$-HCE2-$D_2$ M: 20 mg EP/kg odp | 89.2 | 88.0 | 6.9 | 5.1 | 12.0 |
| (X + M)-$D_0$-HCE2-(X + M)-$D_1$-HCE2-$D_2$ X + M: 20 + 20 mg EP/kg odp | 91.2 | 90.7 | 4.1 | 5.2 | 9.3 |
| (X + M)-$D_0$-HCE2-(X + M)-$D_1$-HCE2-$D_2$ X + M: 10 + 10 mg EP/kg odp | 90.9 | 90.4 | 4.3 | 5.3 | 9.6 |
| Control-$D_0$-HCE6-Control-$D_1$-HCE6-$D_2$ | 89.4 | 87.3 | 6.3 | 6.4 | 12.7 |
| X-$D_0$-HCE6-X-$D_1$-HCE6-$D_2$ X: 20 mg EP/kg odp | 91.2 | 89.8 | 3.5 | 6.7 | 10.2 |
| M-$D_0$-HCE6-M-$D_1$-HCE6-$D_2$ M: 20 mg EP/kg odp | 90.4 | 89.5 | 6.6 | 3.9 | 10.5 |
| (X + M)-$D_0$-HCE6-(X + M)-$D_1$-HCE6-$D_2$ X + M: 20 + 20 mg EP/kg odp | 92.2 | 92.4 | 3.5 | 4.0 | 7.6 |
| (X + M)-$D_0$-HCE6-(X + M)-$D_1$-HCE6-$D_2$ X + M: 10 + 10 mg EP/kg odp | 92.1 | 92.0 | 3.8 | 4.1 | 8.0 |

Example 7

Effect of a Xylanase and Mannanase (X+M) Treatment Combined with Hot Alkaline Extraction Stages and Chlorine Dioxide Stages in the Bleaching and Purification of a Unbleached Softwood Kraft Paper-Grade Pulp: (X+M)-$D_0$-HCE-(X+M)-$D_1$-HCE-$D_2$ Sequence An unbleached softwood kraft pulp was treated with the following sequence of stages at 10% consistency: (X+M)-$D_0$-HCE-(X+M)-$D_1$-HCE-$D_2$. The enzyme-stage used a xylanase (SEQ ID NO: 5; denoted as X) and a mannanase (SEQ ID NO: 6; denoted as M) either alone or combined (X+M) at 10% consistency at 75° C. and pH 4.5 (acetate buffer) for 4 h and using 10 or 20 mg of each enzyme protein (EP)/kg odp (oven-dry pulp; dry matter basis) for each enzyme. For the $D_0$-stage, it was used 1.50% odp $ClO_2$, 80°

Example 8

Effect of an Acid Stage (A) Combined with the Enzyme Based Upgrading Process Applied to an Oxygen Delignified Northern Mixed Hardwood Kraft Paper-Grade Pulp Oxygen delignified northern mixed hardwood kraft pulp was treated with a sequence of stages comprising enzymes (X—xylanase; SEQ ID NO: 5; M—mannanase; SEQ ID NO: 6), hot caustic extraction (HCE at 6% odp NaOH) and chlorine dioxide bleaching (D) as carried out in Example 6: O-(X+M)-$D_0$-HCE6-(X+M)-HCE6-$D_1$. In addition, it was studied the effect of an acid treatment (A-stage) after the first enzyme-stage (X+M). This acid stage was carried out at 10% consistency at an initial pH of 2.0 using sulfuric acid. This A-stage was conducted either at 95° C. for 180 min or at 115° C. for 90 min. When at 95° C., the pulp suspension was put inside a polyethylene bag immersed in a temperature-controlled water bath; as for the experiment at 115° C., the pulp was treated inside a steel beaker pressurized until 2 bar with $N_2$ and then introduced in the Labomat BFA-34 (Werner Mathis AG, Switzerland) oven. After the treatments the pulps were filtered and washed as previously described.

It is seen in Table 9 that the enzyme-based sequence, without the inclusion of the A-stage, allows reaching a level of 12% hemicelluloses in the final O-(X+M)-$D_0$-HCE6-(X+M)-HCE6-$D_1$ treated pulp which corresponds to ca. 46% of hemicelluloses that were removed from the original oxygen deliginified hardwood kraft pulp. When an acid treatment is included in the beginning of the sequences (pre-bleaching), an increased removal of hemicelluloses is obtained up to 53% removal with the more aggressive A-stage at 115° C.

TABLE 9

| Pulp ID | Monossacharide composition (% w/w) glucose | xylose | mannose | Hemicelluloses (% w/w) |
|---|---|---|---|---|
| Original mixed hardwood $O_2$-kraft pulp | 77.8 | 20.9 | 1.3 | 22.2 |
| O-Control-$D_0$-HCE6-Control-HCE6-$D_1$ | 79.7 | 19.2 | 1.1 | 20.3 |
| O-(X + M)-$D_0$-HCE6-(X + M)-HCE6-$D_1$<br>X: 20 mg EP/kg odp<br>M: 20 mg EP/kg odp | 88.0 | 11.2 | 0.8 | 12.0 |
| O-A(95° C.)-Control-$D_0$-HCE6-Control-HCE6-$D_1$ | 82.7 | 16.3 | 1.0 | 17.3 |
| O-A(95° C.)-(X + M)-$D_0$-HCE6-(X + M)-HCE6-$D_1$<br>X: 20 mg EP/kg odp<br>M: 20 mg EP/kg odp | 88.9 | 10.1 | 1.0 | 11.1 |
| O-A(115° C.)-Control-$D_0$-HCE6-Control-HCE6-$D_1$ | 84.7 | 14.4 | 0.9 | 15.3 |
| O-A(115° C.)-(X + M)-$D_0$-HCE6-(X + M)-HCE6-$D_1$<br>X: 20 mg EP/kg odp<br>M: 20 mg EP/kg odp | 89.6 | 9.5 | 0.9 | 10.4 |

Example 9

Effect of a Post Cold Caustic Extraction (CCE) Treatment Combined with the Enzyme Based Upgrading Process Applied to an Oxygen Delignified Northern Mixed Hardwood Kraft Paper-Grade Pulp and to a Softwood Kraft Pulp.

The hardwood pulp treated by O-(X+M)-$D_0$-HCE6-(X+M)-HCE6-$D_1$ in the Example 8 was further treated by a cold caustic extraction (CCE) stage at different NaOH concentrations in the liquid phase of the pulp suspension ranging from ca. 22 to 89 g NaOH/L. The CCE-stage was carried out at 10% consistency with the pulp inside polyethylene bags immersed in a water bath at 35° C. for 30 min. The pulp was then filtered and thoroughly washed with water and afterwards acidified with sulfuric acid at 5% consistency until pH was below 5 for 20 min at room temperature. It was finally filtered and kept for further analysis.

In addition, the softwood pulp treated by (X+M)-$D_0$-HCE6-(X+M)-$D_1$-HCE6-$D_2$ in the Example 7 using 20 mg EP/kg odp of each enzyme in the two (X+M) stages was further treated with a CCE stage following the same procedure as described for the hardwood pulp.

In Table 10 can be seen that the enzyme treated pulps always reach a lower amount of hemicelluloses after the CCE stage for both types of pulps. Considering, for example, a target of 4% residual hemicelluloses in the final pulp, then the enzyme-based sequences allow a noteworthy reduction in the amount of NaOH needed. Using a CCE stage at 80% odp NaOH, it was possible to reach a residual content of hemicelluloses below 5% for both pulps which can be considered sufficient to be qualified as a standard viscose-grade dissolving pulp.

TABLE 10

| NaOH dosage in the Post CCE stage | Monossacharide composition (% w/w) glucose | xylose | mannose | Hemicelluloses (% w/w) |
|---|---|---|---|---|
| Mixed hardwood kraft pulp: O-(X + M)-$D_0$-HCE6-(X + M)-HCE6-$D_1$-CCE | | | | |
| Control: CCE at 20% odp (22.2 g/L or 0.56M) | 83.9 | 15.0 | 1.1 | 16.1 |
| X-treated: Post CCE at 20% odp (22.2 g/L or 0.56M) | 89.9 | 9.5 | 0.6 | 10.1 |
| Control: Post CCE at 40% odp (44.4 g/L or 1.11M) | 88.2 | 11.0 | 0.8 | 11.8 |
| X-treated: Post CCE at 40% odp (44.4 g/L or 1.11M) | 92.7 | 6.6 | 0.6 | 7.3 |
| Control: Post CCE at 80% odp (88.9 g/L or 2.22M) | 94.9 | 4.2 | 0.9 | 5.1 |
| X-treated: Post CCE at 80% odp (88.9 g/L or 2.22M) | 96.6 | 2.8 | 0.6 | 3.4 |
| Softwood kraft pulp: (X + M)-$D_0$-HCE6-(X + M)-$D_1$-HCE6-$D_2$-CCE | | | | |
| Control: CCE at 20% odp (22.2 g/L or 0.56M) | 85.5 | 7.7 | 6.8 | 14.5 |
| X-treated: Post CCE at 20% odp (22.2 g/L or 0.56M) | 92.1 | 3.5 | 4.4 | 7.9 |
| Control: Post CCE at 40% odp (44.4 g/L or 1.11M) | 87.9 | 5.4 | 6.6 | 12.1 |
| X-treated: Post CCE at 40% odp (44.4 g/L or 1.11M) | 93.0 | 2.6 | 4.4 | 7.0 |
| Control: Post CCE at 80% odp (88.9 g/L or 2.22M) | 92.6 | 2.1 | 5.2 | 7.4 |
| X-treated: Post CCE at 80% odp (88.9 g/L or 2.22M) | 95.8 | 0.7 | 3.4 | 4.2 |

SEQUENCE LISTING

<160> NUMBER OF SEQ ID NOS: 7

<210> SEQ ID NO 1
<211> LENGTH: 541
<212> TYPE: PRT
<213> ORGANISM: Ascobolus stictoideus

<400> SEQUENCE: 1

Gln Thr Tyr Thr Leu Glu Ala Glu Ala Gly Thr Leu Thr Gly Val Thr
1 5 10 15

Val Met Asn Glu Ile Ala Gly Phe Ser Gly Thr Gly Tyr Val Gly Gly
20 25 30

Trp Asp Glu Asp Ala Asp Thr Val Ser Leu Thr Phe Thr Ser Asp Ala
35 40 45

Thr Lys Leu Tyr Asp Val Lys Ile Arg Tyr Ser Gly Pro Tyr Gly Ser
50 55 60

Lys Tyr Thr Arg Ile Ser Tyr Asn Gly Ala Thr Gly Gly Asp Ile Ser
65 70 75 80

Leu Pro Glu Thr Thr Glu Trp Ala Thr Val Asn Ala Gly Gln Ala Leu
85 90 95

Leu Asn Ala Gly Ser Asn Thr Ile Lys Leu His Asn Asn Trp Gly Trp
100 105 110

Tyr Leu Ile Asp Ala Val Ile Leu Thr Pro Ser Val Pro Arg Pro Pro
115 120 125

His Gln Val Thr Asp Ala Leu Val Asn Thr Asn Ser Asn Ala Val Thr
130 135 140

Lys Gln Leu Met Lys Phe Leu Val Ser Lys Tyr His Lys Ala Tyr Ile
145 150 155 160

Thr Gly Gln Gln Glu Leu His Ala His Gln Trp Val Glu Lys Asn Val
165 170 175

Gly Lys Ser Pro Ala Ile Leu Gly Leu Asp Phe Met Asp Tyr Ser Pro
180 185 190

Ser Arg Val Glu Phe Gly Thr Thr Ser Gln Ala Val Glu Gln Ala Ile
195 200 205

Asp Phe Asp Lys Arg Gly Gly Ile Val Thr Phe Ala Trp His Trp Asn
210 215 220

Ala Pro Ser Gly Leu Ile Asn Thr Pro Gly Ser Glu Trp Trp Arg Gly
225 230 235 240

Phe Tyr Thr Glu His Thr Thr Phe Asp Val Ala Ala Ala Leu Gln Asn
245 250 255

Thr Thr Asn Ala Asn Tyr Asn Leu Leu Ile Arg Asp Ile Asp Ala Ile
260 265 270

Ala Val Gln Leu Lys Arg Leu Gln Thr Ala Gly Val Pro Val Leu Trp
275 280 285

Arg Pro Leu His Glu Ala Glu Gly Gly Trp Phe Trp Trp Gly Ala Lys
290 295 300

Gly Pro Glu Pro Ala Lys Lys Leu Tyr Lys Ile Leu Tyr Asp Arg Leu
305 310 315 320

Thr Asn Tyr His Lys Leu Asn Asn Leu Ile Trp Val Trp Asn Ser Val
325 330 335

Ala Lys Asp Trp Tyr Pro Gly Asp Glu Ile Val Asp Val Leu Ser Phe
340 345 350

Asp Ser Tyr Pro Ala Gln Pro Gly Asp His Gly Pro Val Ser Ala Gln
355 360 365

```
Tyr Asn Ala Leu Val Glu Leu Gly Lys Asp Lys Lys Leu Ile Ala Ala
    370                 375                 380

Thr Glu Val Gly Thr Ile Pro Asp Pro Asp Leu Met Gln Leu Tyr Glu
385                 390                 395                 400

Ser Tyr Trp Ser Phe Phe Val Thr Trp Glu Gly Glu Phe Ile Glu Asn
                405                 410                 415

Gly Val His Asn Ser Leu Glu Phe Leu Lys Lys Leu Tyr Asn Asn Ser
            420                 425                 430

Phe Val Leu Asn Leu Asp Thr Ile Gln Gly Trp Lys Asn Gly Ala Gly
        435                 440                 445

Ser Ser Thr Thr Thr Val Lys Ser Thr Thr Thr Thr Pro Thr Thr Thr
    450                 455                 460

Ile Lys Ser Thr Thr Thr Thr Pro Val Thr Thr Pro Thr Thr Val Lys
465                 470                 475                 480

Thr Thr Thr Thr Pro Thr Thr Thr Ala Thr Thr Val Lys Ser Thr Thr
                485                 490                 495

Thr Thr Ala Gly Pro Thr Pro Thr Ala Val Ala Gly Arg Trp Gln Gln
            500                 505                 510

Cys Gly Gly Ile Gly Phe Thr Gly Pro Thr Thr Cys Glu Ala Gly Thr
        515                 520                 525

Thr Cys Asn Val Leu Asn Pro Tyr Tyr Ser Gln Cys Leu
    530                 535                 540


<210> SEQ ID NO 2
<211> LENGTH: 526
<212> TYPE: PRT
<213> ORGANISM: Chaetomium virescens

<400> SEQUENCE: 2

Pro Arg Asp Pro Gly Ala Thr Ala Arg Thr Phe Glu Ala Glu Asp Ala
1               5                   10                  15

Thr Leu Ala Gly Thr Asn Val Asp Thr Ala Leu Ser Gly Phe Thr Gly
            20                  25                  30

Thr Gly Tyr Val Thr Gly Phe Asp Gln Ala Ala Asp Lys Val Thr Phe
        35                  40                  45

Thr Val Asp Ser Ala Ser Thr Glu Leu Tyr Asp Leu Ser Ile Arg Val
    50                  55                  60

Ala Ala Ile Tyr Gly Asp Lys Arg Thr Ser Val Val Leu Asn Gly Gly
65                  70                  75                  80

Ala Ser Ser Glu Val Tyr Phe Pro Ala Gly Glu Thr Trp Thr Asn Val
                85                  90                  95

Ala Ala Gly Gln Leu Leu Leu Asn Gln Gly Ser Asn Thr Ile Asp Ile
            100                 105                 110

Val Ser Asn Trp Gly Trp Tyr Leu Ile Asp Ser Ile Thr Leu Thr Pro
        115                 120                 125

Ser Thr Pro Arg Pro Ala His Gln Ile Asn Glu Ala Pro Val Asn Ala
    130                 135                 140

Ala Ala Asp Lys Asn Ala Lys Ala Leu Tyr Ser Tyr Leu Arg Ser Ile
145                 150                 155                 160

Tyr Gly Lys Lys Ile Leu Ser Gly Gln Gln Glu Leu Ser Leu Ser Asn
                165                 170                 175

Trp Ile Ala Gln Gln Thr Gly Lys Thr Pro Ala Leu Val Ser Val Asp
            180                 185                 190

Leu Met Asp Tyr Ser Pro Ser Arg Val Glu Arg Gly Thr Val Gly Thr
        195                 200                 205
```

```
Ala Val Glu Glu Ala Ile Gln His His Asn Arg Gly Gly Ile Val Ser
    210                 215                 220

Val Leu Trp His Trp Asn Ala Pro Thr Gly Leu Tyr Asp Thr Glu Glu
225                 230                 235                 240

His Arg Trp Trp Ser Gly Phe Tyr Thr Ser Ala Thr Asp Phe Asp Val
                245                 250                 255

Ala Ala Ala Leu Ser Ser Thr Thr Asn Ala Asn Tyr Thr Leu Leu Ile
            260                 265                 270

Arg Asp Ile Asp Ala Ile Ala Val Gln Leu Lys Arg Leu Gln Ser Ala
        275                 280                 285

Gly Val Pro Val Leu Phe Arg Pro Leu His Glu Ala Glu Gly Gly Trp
    290                 295                 300

Phe Trp Trp Gly Ala Lys Gly Pro Glu Pro Ala Lys Lys Leu Trp Gly
305                 310                 315                 320

Ile Leu Tyr Asp Arg Val Thr Asn His His Gln Ile Asn Asn Leu Leu
                325                 330                 335

Trp Val Trp Asn Ser Ile Leu Pro Glu Trp Tyr Pro Gly Asp Ala Thr
            340                 345                 350

Val Asp Ile Leu Ser Ala Asp Val Tyr Ala Gln Gly Asn Gly Pro Met
        355                 360                 365

Ser Thr Gln Tyr Asn Gln Leu Ile Glu Leu Gly Lys Asp Lys Lys Met
    370                 375                 380

Ile Ala Ala Ala Glu Val Gly Ala Ala Pro Leu Pro Asp Leu Leu Gln
385                 390                 395                 400

Ala Tyr Glu Ala His Trp Leu Trp Phe Thr Val Trp Gly Asp Ser Phe
                405                 410                 415

Ile Asn Asn Ala Asp Trp Asn Ser Leu Asp Thr Leu Lys Lys Val Tyr
            420                 425                 430

Thr Ser Asp Tyr Val Leu Thr Leu Asp Glu Ile Gln Gly Trp Gln Gly
        435                 440                 445

Ser Thr Pro Ser Ala Thr Thr Thr Ser Ser Thr Thr Thr Pro Ser Ala
    450                 455                 460

Thr Thr Thr Thr Thr Thr Pro Ser Thr Thr Ala Thr Thr Ala Thr Pro
465                 470                 475                 480

Ser Ala Thr Thr Thr Ala Ser Pro Val Thr Tyr Ala Glu His Trp Gly
                485                 490                 495

Gln Cys Ala Gly Lys Gly Trp Thr Gly Pro Thr Thr Cys Arg Pro Pro
            500                 505                 510

Tyr Thr Cys Lys Tyr Gln Asn Asp Trp Tyr Ser Gln Cys Leu
        515                 520                 525


<210> SEQ ID NO 3
<211> LENGTH: 437
<212> TYPE: PRT
<213> ORGANISM: Trichoderma reesei
<220> FEATURE:
<221> NAME/KEY: mat_peptide
<222> LOCATION: (20)..(437)

<400> SEQUENCE: 3

Met Met Met Leu Ser Lys Ser Leu Leu Ser Ala Ala Thr Ala Ala Ser
                -15                 -10                 -5

Ala Leu Ala Ala Val Leu Gln Pro Val Pro Arg Ala Ser Ser Phe Val
        -1  1               5                   10

Thr Ile Ser Gly Thr Gln Phe Asn Ile Asp Gly Lys Val Gly Tyr Phe
```

```
    15                  20                  25

Ala Gly Thr Asn Cys Tyr Trp Cys Ser Phe Leu Thr Asn His Ala Asp
30                  35                  40                  45

Val Asp Ser Thr Phe Ser His Ile Ser Ser Ser Gly Leu Lys Val Val
                50                  55                  60

Arg Val Trp Gly Phe Asn Asp Val Asn Thr Gln Pro Ser Pro Gly Gln
            65                  70                  75

Ile Trp Phe Gln Lys Leu Ser Ala Thr Gly Ser Thr Ile Asn Thr Gly
        80                  85                  90

Ala Asp Gly Leu Gln Thr Leu Asp Tyr Val Val Gln Ser Ala Glu Gln
    95                  100                 105

His Asn Leu Lys Leu Ile Ile Pro Phe Val Asn Asn Trp Ser Asp Tyr
110                 115                 120                 125

Gly Gly Ile Asn Ala Tyr Val Asn Ala Phe Gly Gly Asn Ala Thr Thr
                130                 135                 140

Trp Tyr Thr Asn Thr Ala Ala Gln Thr Gln Tyr Arg Lys Tyr Val Gln
            145                 150                 155

Ala Val Val Ser Arg Tyr Ala Asn Ser Thr Ala Ile Phe Ala Trp Glu
        160                 165                 170

Leu Gly Asn Glu Pro Arg Cys Asn Gly Cys Ser Thr Asp Val Ile Val
    175                 180                 185

Gln Trp Ala Thr Ser Val Ser Gln Tyr Val Lys Ser Leu Asp Ser Asn
190                 195                 200                 205

His Leu Val Thr Leu Gly Asp Glu Gly Leu Gly Leu Ser Thr Gly Asp
                210                 215                 220

Gly Ala Tyr Pro Tyr Thr Tyr Gly Glu Gly Thr Asp Phe Ala Lys Asn
            225                 230                 235

Val Gln Ile Lys Ser Leu Asp Phe Gly Thr Phe His Leu Tyr Pro Asp
        240                 245                 250

Ser Trp Gly Thr Asn Tyr Thr Trp Gly Asn Gly Trp Ile Gln Thr His
    255                 260                 265

Ala Ala Ala Cys Leu Ala Ala Gly Lys Pro Cys Val Phe Glu Glu Tyr
270                 275                 280                 285

Gly Ala Gln Gln Asn Pro Cys Thr Asn Glu Ala Pro Trp Gln Thr Thr
                290                 295                 300

Ser Leu Thr Thr Arg Gly Met Gly Gly Asp Met Phe Trp Gln Trp Gly
            305                 310                 315

Asp Thr Phe Ala Asn Gly Ala Gln Ser Asn Ser Asp Pro Tyr Thr Val
        320                 325                 330

Trp Tyr Asn Ser Ser Asn Trp Gln Cys Leu Val Lys Asn His Val Asp
    335                 340                 345

Ala Ile Asn Gly Gly Thr Thr Thr Pro Pro Pro Val Ser Ser Thr Thr
350                 355                 360                 365

Thr Thr Ser Ser Arg Thr Ser Ser Thr Pro Pro Pro Pro Gly Gly Ser
                370                 375                 380

Cys Ser Pro Leu Tyr Gly Gln Cys Gly Gly Ser Gly Tyr Thr Gly Pro
            385                 390                 395

Thr Cys Cys Ala Gln Gly Thr Cys Ile Tyr Ser Asn Tyr Trp Tyr Ser
        400                 405                 410

Gln Cys Leu Asn Thr
    415
```

<210> SEQ ID NO 4

<211> LENGTH: 221
<212> TYPE: PRT
<213> ORGANISM: Bacillus agaradhaerens

<400> SEQUENCE: 4

Gln Ile Val Thr Asp Asn Ser Ile Gly Asn His Asp Gly Tyr Asp Tyr
1 5 10 15

Glu Phe Trp Lys Asp Ser Gly Gly Ser Gly Thr Met Ile Leu Asn His
20 25 30

Gly Gly Thr Phe Ser Ala Gln Trp Asn Asn Val Asn Asn Ile Leu Phe
35 40 45

Arg Lys Gly Lys Lys Phe Asn Glu Thr Gln Thr His Gln Gln Val Gly
50 55 60

Asn Met Ser Ile Asn Tyr Gly Ala Asn Phe Gln Pro Asn Gly Asn Ala
65 70 75 80

Tyr Leu Cys Val Tyr Gly Trp Thr Val Asp Pro Leu Val Glu Tyr Tyr
85 90 95

Ile Val Asp Ser Trp Gly Asn Trp Arg Pro Pro Gly Ala Thr Pro Lys
100 105 110

Gly Thr Ile Thr Val Asp Gly Gly Thr Tyr Asp Ile Tyr Glu Thr Leu
115 120 125

Arg Val Asn Gln Pro Ser Ile Lys Gly Ile Ala Thr Phe Lys Gln Tyr
130 135 140

Trp Ser Val Arg Arg Ser Lys Arg Thr Ser Gly Thr Ile Ser Val Ser
145 150 155 160

Asn His Phe Arg Ala Trp Glu Asn Leu Gly Met Asn Met Gly Lys Met
165 170 175

Tyr Glu Val Ala Leu Thr Val Glu Gly Tyr Gln Ser Ser Gly Ser Ala
180 185 190

Asn Val Tyr Ser Asn Thr Leu Arg Ile Asn Gly Asn Pro Leu Ser Thr
195 200 205

Ile Ser Asn Asp Lys Ser Ile Thr Leu Asp Lys Asn Asn
210 215 220

<210> SEQ ID NO 5
<211> LENGTH: 203
<212> TYPE: PRT
<213> ORGANISM: Dictyoglomus thermophilum

<400> SEQUENCE: 5

Gln Thr Ser Ile Thr Leu Thr Ser Asn Ala Ser Gly Thr Phe Asp Gly
1 5 10 15

Tyr Tyr Tyr Glu Leu Trp Lys Asp Thr Gly Asn Thr Thr Met Thr Val
20 25 30

Tyr Thr Gln Gly Arg Phe Ser Cys Gln Trp Ser Asn Ile Asn Asn Ala
35 40 45

Leu Phe Arg Thr Gly Lys Lys Tyr Asn Gln Asn Trp Gln Ser Leu Gly
50 55 60

Thr Ile Arg Ile Thr Tyr Ser Ala Thr Tyr Asn Pro Asn Gly Asn Ser
65 70 75 80

Tyr Leu Cys Ile Tyr Gly Trp Ser Thr Asn Pro Leu Val Glu Phe Tyr
85 90 95

Ile Val Glu Ser Trp Gly Asn Trp Arg Pro Pro Gly Ala Thr Ser Leu
100 105 110

Gly Gln Val Thr Ile Asp Gly Gly Thr Tyr Asp Ile Tyr Arg Thr Thr
115 120 125

```
Arg Val Asn Gln Pro Ser Ile Val Gly Thr Ala Thr Phe Asp Gln Tyr
    130                 135                 140

Trp Ser Val Arg Thr Ser Lys Arg Thr Ser Gly Thr Val Thr Val Thr
145                 150                 155                 160

Asp His Phe Arg Ala Trp Ala Asn Arg Gly Leu Asn Leu Gly Thr Ile
                165                 170                 175

Asp Gln Ile Thr Leu Cys Val Glu Gly Tyr Gln Ser Ser Gly Ser Ala
            180                 185                 190

Asn Ile Thr Gln Asn Thr Phe Ser Gln Gly Ser
        195                 200


<210> SEQ ID NO 6
<211> LENGTH: 335
<212> TYPE: PRT
<213> ORGANISM: Caldicellulosiruptor saccharolyticus
<220> FEATURE:
<221> NAME/KEY: SIGNAL
<222> LOCATION: (1)..(27)
<220> FEATURE:
<221> NAME/KEY: mat_peptide
<222> LOCATION: (28)..(335)

<400> SEQUENCE: 6

Met Lys Lys Pro Leu Gly Lys Ile Val Ala Ser Thr Ala Leu Leu Ile
        -25                 -20                 -15

Ser Val Ala Phe Ser Ser Ser Ile Ala Ser Ala Ala Thr Ser Asn Asp
    -10                 -5              -1  1               5

Gly Val Val Lys Ile Asp Thr Ser Thr Leu Ile Gly Thr Asn His Ala
                10                  15                  20

His Cys Trp Tyr Arg Asp Arg Leu Asp Thr Ala Leu Arg Gly Ile Arg
            25                  30                  35

Ser Trp Gly Met Asn Ser Val Arg Val Val Leu Ser Asn Gly Tyr Arg
        40                  45                  50

Trp Thr Lys Ile Pro Ala Ser Glu Val Ala Asn Ile Ile Ser Leu Ser
    55                  60                  65

Arg Ser Leu Gly Phe Lys Ala Ile Ile Leu Glu Val His Asp Thr Thr
70                  75                  80                  85

Gly Tyr Gly Glu Asp Gly Ala Ala Cys Ser Leu Ala Gln Ala Val Glu
                90                  95                  100

Tyr Trp Lys Glu Ile Lys Ser Val Leu Asp Gly Asn Glu Asp Phe Val
            105                 110                 115

Ile Ile Asn Ile Gly Asn Glu Pro Tyr Gly Asn Asn Asn Tyr Gln Asn
        120                 125                 130

Trp Val Asn Asp Thr Lys Asn Ala Ile Lys Ala Leu Arg Asp Ala Gly
    135                 140                 145

Phe Lys His Thr Ile Met Val Asp Ala Pro Asn Trp Gly Gln Asp Trp
150                 155                 160                 165

Ser Asn Thr Met Arg Asp Asn Ala Gln Ser Ile Met Glu Ala Asp Pro
                170                 175                 180

Leu Arg Asn Leu Val Phe Ser Ile His Met Tyr Gly Val Tyr Asn Thr
            185                 190                 195

Ala Ser Lys Val Glu Glu Tyr Ile Lys Ser Phe Val Asp Lys Gly Leu
        200                 205                 210

Pro Leu Val Ile Gly Glu Phe Gly His Gln His Thr Asp Gly Asp Pro
    215                 220                 225

Asp Glu Glu Ala Ile Val Arg Tyr Ala Lys Gln Tyr Lys Ile Gly Leu
```

```
230                 235                 240                 245

Phe Ser Trp Ser Trp Cys Gly Asn Ser Ser Tyr Val Gly Tyr Leu Asp
                250                 255                 260

Met Val Asn Asn Trp Asp Pro Asn Asn Pro Thr Pro Trp Gly Gln Trp
            265                 270                 275

Tyr Lys Thr Asn Ala Ile Gly Thr Ser Ser Thr Pro Thr Pro Thr Ser
        280                 285                 290

Thr Val Thr Pro Thr Pro Pro Pro Arg Gln His Gln His Arg Gln
    295                 300                 305


<210> SEQ ID NO 7
<211> LENGTH: 379
<212> TYPE: PRT
<213> ORGANISM: Talaromyces leycettanus
<220> FEATURE:
<221> NAME/KEY: signal
<222> LOCATION: (1)..(16)
<220> FEATURE:
<221> NAME/KEY: mat_peptide
<222> LOCATION: (17)..(379)

<400> SEQUENCE: 7

Met Lys Leu Ser Asn Ala Leu Leu Thr Leu Ala Ser Leu Ala Leu Ala
    -15                 -10                 -5                  -1

Asn Val Ser Thr Ala Leu Pro Lys Ala Ser Pro Ala Pro Ser Thr Ser
1               5                   10                  15

Ser Ser Ala Ala Ser Thr Ser Ile Pro Ser Lys Asn Gly Leu Lys Phe
            20                  25                  30

Thr Ile Asp Gly Lys Thr Ala Tyr Tyr Ala Gly Thr Asn Thr Tyr Trp
        35                  40                  45

Leu Pro Phe Leu Thr Asn Asn Ala Asp Val Asp Leu Val Met Ser His
    50                  55                  60

Leu Gln Gln Ser Gly Leu Lys Ile Leu Arg Val Trp Gly Phe Asn Asp
65                  70                  75                  80

Val Asn Thr Gln Pro Gly Ser Gly Thr Val Trp Phe Gln Leu Leu Gln
                85                  90                  95

Asn Gly Gln Ala Thr Ile Asn Thr Gly Ala Asn Gly Leu Gln Arg Leu
            100                 105                 110

Asp Tyr Val Val Gln Ser Ala Glu Ala His Asp Ile Lys Leu Ile Ile
        115                 120                 125

Asn Phe Val Asn Asn Trp Asn Asp Tyr Gly Gly Ile Asn Ala Tyr Val
    130                 135                 140

Asn Asn Tyr Gly Gly Asn Ala Thr Thr Trp Tyr Thr Asn Ser Ala Ala
145                 150                 155                 160

Gln Ala Ala Tyr Arg Asn Tyr Ile Lys Ala Val Ile Ser Arg Tyr Ile
                165                 170                 175

Gly Ser Pro Ala Ile Phe Ala Trp Glu Leu Ala Asn Glu Pro Arg Cys
            180                 185                 190

His Gly Cys Asp Thr Ser Val Ile Tyr Asn Trp Val Ser Ser Thr Ser
        195                 200                 205

Ala Tyr Ile Lys Ser Leu Glu Pro Asn Arg Met Val Cys Ile Gly Asp
    210                 215                 220

Glu Gly Met Gly Leu Thr Thr Gly Ser Asp Gly Ser Tyr Pro Phe Gln
225                 230                 235                 240

Tyr Thr Glu Gly Thr Asp Phe Glu Lys Asn Leu Ala Ile Pro Thr Ile
                245                 250                 255
```

-continued

```
Asp Phe Gly Thr Leu His Leu Tyr Pro Ser Ser Trp Gly Glu Gln Asp
            260                 265                 270

Ser Trp Gly Ser Thr Trp Ile Ser Ala His Gly Gln Ala Cys Val Asn
        275                 280                 285

Ala Gly Lys Pro Cys Leu Leu Glu Glu Tyr Gly Ser Thr Asn His Cys
    290                 295                 300

Ser Ser Glu Ala Pro Trp Gln Ser Thr Ala Leu Ser Thr Asn Gly Ile
305                 310                 315                 320

Ala Ala Asp Ser Phe Trp Gln Tyr Gly Asp Thr Leu Ser Thr Gly Gln
                325                 330                 335

Ser Pro Asn Asp Gly Tyr Thr Ile Tyr Tyr Gly Ser Ser Asp Tyr Thr
            340                 345                 350

Cys Leu Val Thr Asn His Ile Ser Gln Phe Gln
        355                 360
```

The invention claimed is:

1. A method of producing a dissolving pulp comprising less than 10% hemicellulose, said method comprising the steps of:

i) treating a paper-grade alkaline pulp with one or more hemicellulases, wherein said one or more hemicellulases comprise one or more xylanases having an amino add sequence that is at least 60% identical to SEQ ID NO: 4 and/or SEQ ID NO: 5; and ii) performing hot caustic extraction of the paper-grade alkaline pulp using an alkaline source at a temperature from 80° C. to 160° C. and alkaline conditions of from 0.01 M to 1 M hydroxide ions.

2. The method of claim 1, wherein said one or more hemicellulases comprise one or more xylanases having an amino acid sequence that is at least 90% identical to SEQ ID NO: 4 and/or SEQ ID NO: 5.

3. The method of claim 1, wherein said one or more hemicellulases further comprise one or more mannanases.

4. A method of producing a dissolving pulp comprising less than 10% hemicellulose, said method comprising the steps of:

i) treating a paper-grade alkaline pulp with one or more hemucellulases, wherein said one or more hemicellulases comprise one or more xylanases selected from the group consisting of SEQ ID NO: 4 and SEQ ID NO: 5 ;and (ii) performing hot caustic extraction of the paper-grade alkaline pulp using an alkaline source at a temperature from 80° C. to 160° C. and alkaline conditions from 0.01 M to 1 M hydroxide ions.

5. The method of claim 1, wherein said one or more hemicellulases comprise one or more xylanases having an amino acid sequence that is at least 95% identical to SEQ ID NO: 4 and/or SEQ ID NO: 5.

6. The method of claim 1, wherein said one or more hemicellulases further comprise one or more mannanases selected from the group consisting of SEQ ID NO: 1, SEQ ID NO: 2, SEQ ID NO: 3, SEQ ID NO: 6 and SEQ ID NO: 7.

7. The method of claim 1, wherein said one or more hemicellulases further comprise one or more mannanases having an amino acid sequence that is at least 60% identical to SEQ ID NO: 1, SEQ ID NO: 2, SEQ ID NO: 3, SEQ ID NO: 6 and/or SEQ ID NO:7.

8. The method of claim 1, wherein said one or more hemicellulases further comprise one or more mannanases that is at least 90% identical to SEQ ID NO: 1, SED ID NO: 2, SEQ ID NO: 3, SEQ ID NO: 6 and/or SEQ ID NO: 7.

9. The method of claim 1, wherein said one or more hemicellulases are present in a concentration ranging from 0.05 mg/kg oven-dried pulp to 100 mg/kg oven-dried pulp.

10. The method of claim 1, wherein said alkaline source comprises NaOH, $Ca(OH)_2$, $NH_4OH$ and/or $Mg(OH)_2$.

11. The method of claim 1, wherein said hot caustic extraction is performed with a NaOH concentration of less than 0.75 M.

12. The method of claim 1, wherein said paper-grade alkaline pulp is selected from the group consisting of alkaline hardwood pulp, alkaline softwood pulp, kraft pulp, hardwood kraft pulp, softwood kraft pulp, soda pulp, hardwood soda pulp and softwood soda pulp, or any mixture thereof.

13. The method of claim 1, wherein the hemicellulose content of the generated dissolving pulp is less than 5%.

14. The method of claim 1, wherein said paper-grade alkaline pulp is softwood pulp or a mixture of softwood pulp and hardwood pulp and wherein said one or more hemicellulases comprises one or more xylanases and one or more mannanases.

15. The method of claim 1, wherein step i) is repeated two or more times.

16. The method of claim 1, wherein step ii) is repeated two or more times.

17. The method of claim 1, wherein step i) and step ii) are repeated two or more times.

18. A method of producing a dissolving pulp comprising of less than 10% hemicellulose, said method comprising the steps of:

(i) treating a paper-grade alkaline pulp with one or more hemicellulases;

(ii) performing hot caustic extraction of the paper-grade alkaline pulp using an alkaline source at a temperature from 80° C. to 160° C. and alkaline conditions of from 0.01 M to 1 M hydroxide ions; and iii) performing Cold Caustic Extraction of the paper-grade alkaline pulp or the dissolving pulp with an alkaline source at a temperature from 10° C. to 50° C. and at alkaline conditions of from 1.0 M to 3 M hydroxide ions.

19. The method of claim 18, wherein said Cold Caustic Extraction is performed after step i) and after step ii).

20. The method of claim 18, wherein said Cold Caustic Extraction is performed between step i) and ii).

* * * * *